US006669526B2

(12) United States Patent
Manville et al.

(10) Patent No.: US 6,669,526 B2
(45) Date of Patent: Dec. 30, 2003

(54) CONSTRUCTION TOY SET HAVING LOW INSERTION FORCE CONNECTING BODIES

(75) Inventors: Richard B. Manville, Los Angeles, CA (US); James P. Mills-Winkler, Long Beach, CA (US); Armen Danielian, Woodland Hills, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 10/108,024

(22) Filed: Mar. 26, 2002

(65) Prior Publication Data

US 2003/0224690 A1 Dec. 4, 2003

(51) Int. Cl.[7] ..... A63H 33/00
(52) U.S. Cl. ..... 446/113; 446/97; 446/100
(58) Field of Search ..... 446/97, 99, 100, 446/101–102, 104–108, 111–116, 119–122, 124–128

(56) References Cited

U.S. PATENT DOCUMENTS

| | | | | |
|---|---|---|---|---|
| 1,707,691 | A | * | 4/1929 | Sweet |
| 1,818,404 | A | | 9/1931 | Kaufman |
| 2,506,328 | A | * | 5/1950 | Alger |
| 3,564,758 | A | | 2/1971 | Willis |
| 3,687,500 | A | | 8/1972 | Silvius |
| 3,827,177 | A | | 8/1974 | Wengel |
| 3,855,748 | A | | 12/1974 | Thomas |
| 3,866,348 | A | * | 2/1975 | Roby et al. ..... 46/22 |
| 4,124,958 | A | | 11/1978 | Chiche |
| 4,291,512 | A | | 9/1981 | Walton |
| 4,334,868 | A | | 6/1982 | Levinrad |
| 4,365,454 | A | | 12/1982 | Davis |
| D277,727 | S | | 2/1985 | Klaric |
| 4,557,091 | A | | 12/1985 | Auer |
| D285,463 | S | | 9/1986 | Davis |
| 4,731,041 | A | * | 3/1988 | Ziegler ..... 446/115 |
| 4,789,370 | A | | 12/1988 | Ellefson |
| 4,846,750 | A | * | 7/1989 | Tapdrup ..... 446/128 |
| 5,049,105 | A | * | 9/1991 | Glickman ..... 446/126 |
| 5,061,219 | A | | 10/1991 | Glickman |
| 5,121,526 | A | * | 6/1992 | Burkard et al. ..... 24/336 |
| 5,222,902 | A | | 6/1993 | Piersch |
| 5,357,761 | A | | 10/1994 | Schauer |
| 5,470,139 | A | | 11/1995 | Hsiao |
| 5,472,365 | A | | 12/1995 | Engel |
| 5,647,181 | A | | 7/1997 | Hunts |
| 5,681,201 | A | | 10/1997 | Choi |
| 5,984,756 | A | | 11/1999 | Krog |
| 6,004,182 | A | * | 12/1999 | Pasin ..... 446/105 |
| 6,176,953 | B1 | | 1/2001 | Landreth et al. |
| 6,231,416 | B1 | | 5/2001 | Clever et al. |
| 6,250,986 | B1 | * | 6/2001 | Sorensen ..... 446/85 |
| 6,283,456 | B1 | | 9/2001 | Benz et al. |
| 6,419,542 | B1 | * | 7/2002 | Liu ..... 446/97 |

FOREIGN PATENT DOCUMENTS

| | | | |
|---|---|---|---|
| GB | 2077879 | * | 12/1981 |

* cited by examiner

*Primary Examiner*—Jacob K. Ackun
*Assistant Examiner*—Jamila Williams
(74) *Attorney, Agent, or Firm*—Roy A. Ekstrand

(57) ABSTRACT

A plurality of connecting bodies are formed in various shapes of a resilient material such as molded plastic or other resilient material. The connecting bodies each define a plurality of inwardly extending slots which form receiving mechanisms for the edge portions of a plurality of cooperating generally planar plate members. The plate members are assembled to form more complex structures utilizing the connecting bodies to form interconnection therebetween. In alternate embodiments, a complex structure for the inwardly extending slots includes flexible ribs on each side of the slots together with relief slots adjacent the ribs. In further alternate embodiments, the connecting bodies and plate members may be assembled to form complex fanciful figures utilizing specialized elements such as a fanciful head member which bears a fanciful face and leg elements.

5 Claims, 18 Drawing Sheets

496
498
497
500
501
471
470
430
499
472
473
505
434
432
433
431
444
445
441
442
456
454
443
440
450
453
451
452
32
447
446
30
503
502
31
146
140
149
142
144
462
463
460
150
148
147
461
143

CONSTRUCTION TOY SET HAVING LOW INSERTION FORCE CONNECTING BODIES

FIELD OF THE INVENTION

This invention relates generally to construction toy sets and particularly to the connecting elements used therein.

BACKGROUND OF THE INVENTION

Construction toy sets are well known in the art and have been extremely popular with children of various ages for many years. Early construction toy sets were relatively primitive being fabricated of wooden elements in combinations of block, dowels, pins, pegs and panels. Through the years however, more modem and often more complex molded plastic construction toy sets have been developed. While the variety of construction toy sets produced by practitioners in the art is virtually endless, such construction toy sets all generally include a plurality of structural elements utilized in combination with various connecting mechanisms. The connecting mechanisms facilitate the assembly of the plural elements into a variety of generally larger structures, figures or other toys such as vehicles or the like.

Construction toy sets are often endorsed and encouraged by child development experts due to the many developmental activities which they encourage. These developmental activities include the exercise of spatial relationships, geometric form recognition and manipulation, as well as structural analysis together with imagination and creativity. Not surprisingly, the long term popularity and developmental benefits provided by construction toy sets has prompted practitioners in the toy arts to develop a dizzying array of construction toy sets. For example, U.S. Pat. No. 3,827,177 issued to Wengel sets forth a CONSTRUCTION GAME having a plurality of generally planar elements defining reduced web sections about the edges thereof together with a plurality of somewhat resilient connectors formed to define multiple radial slots. The reduced web sections of the planar elements are receivable within the radial slots of the resilient connectors to provide interconnection and assembly of more complex structures.

U.S. Pat. No. 3,564,758 issued to Willis sets forth POLYGONAL BUILDING ELEMENTS WITH CONNECTORS THEREFOR FOR ASSEMBLING TOY STRUCTURES having variously shaped connectors such as triangles, rectangles or octagons each of which defines a plurality of inwardly extending slots for receiving inserted planar structural elements.

U.S. Pat. No. 3,855,748 issued to Thomas sets forth a PLAYGROUND ASSEMBLY SET consisting of a plurality of planar elements of at least two different sizes. One element is substantially larger than the other element and both elements define notches in strategic locations. The cooperating notches facilitate the connection between the elements to form more complex structures.

U.S. Pat. No. 4,789,370 issued to Ellefson sets forth an APPARATUS FOR INTERLOCKING STRUCTURAL ELEMENTS OF TOY DISKS having a relatively thin flat structural member defining inwardly extending notches for receiving cooperating thin flat elements. The notches define inwardly extending bosses on either side of the notches while the thin flat body defines voids on each side of the slots. The voids facilitate the expansion of the interior portion of the slots to facilitate element insertion.

U.S. Pat. No. 4,334,868 issued to Levinrad sets forth CONSTRUCTIONAL KITS having elongated connectors and cooperating panels. The elongated connectors are incapable of mutual joining but are structured to join to the panels. The elongated connectors comprise elongated bodies having longitudinal groves which receive the edge portions of the interconnecting panels in a tight fit.

U.S. Pat. No. 5,061,219 issued to Glickman sets forth a CONSTRUCTION TOY having a plurality of hub-like connectors together with a plurality of elongated structural elements. The hub-like connectors define one or more gripping sockets which cooperate with the end portions of the structural members to facilitate attachment therebetween which allows the structural members to rotate about its major axis.

U.S. Pat. No. 5,984,756 issued to Krog sets forth a TOY CONSTRUCTION SYSTEM having a plurality of elongated building elements each having a receiving notch at the end portion thereof. The construction set further includes a plurality of interconnecting elements each supporting a plurality of outwardly extending head structures. The head structures are fabricated to be receivable within the end notches in a snap-fit attachment.

Additional examples of construction toy sets are found in U.S. Pat. No. Des. 285,463 issued to Davis; U.S. Pat. No. 5,681,201 issued Choi; and U.S. Pat. No. 6,231,416B1issued to Cleaver et al.

In a somewhat related art, practitioners have endeavored to provide various structures and display enclosures formed of interconnecting combinations of panels. While the need and challenges of such structures and display enclosures is often substantially different than the corresponding needs and objectives of construction toy sets, surprisingly similar structural elements and combinations have been developed in this art. For example, U.S. Pat. No. 4,124,958 issued to ChiChe sets forth a SPHERICAL JUNCTION ELEMENT FOR COMPOSABLE DISPLAY STRUCTURES having a body defining at least one partially spherical outside surface, at least one flat outside surface intersecting the partially spherical surface, at least one slot formed in the partially spherical surface which is perpendicular to the flat surface and which receives therein a plate-like component member.

U.S. Pat. No. Des. 277,727 issued to Kiaric sets forth a CONSTRUCTION JOINT having a generally spherical body defining a plurality of inwardly extending radial slots. The body further defines an axial passage generally parallel to the slots and extending through a major diameter of the spherical body.

U.S. Pat. No. 3,687,500 issued to Silvius sets forth CONNECTING CONSTRUCTION FOR SHEET MEMBERS utilized in interconnecting mutually perpendicular materials. The connectors comprise small planar elements defining inwardly slots at ninety degree intervals. Each connector may be formed as a one piece plate of rigidly flexible and deformable material or may have one or more plates of flexible material between clamping plates of stiffer material.

U.S. Pat. No. 4,365,454 issued to Davis sets forth a CONSTRUCTION SYSTEM consisting of a plurality of flat main bodies having recesses formed in the edges thereof together with a centrally hinged connecting member having opposed planar portions which fit into to recesses to provide interconnection between the flat main bodies.

U.S. Pat. No. 6,004,182 issued to Pasin sets forth a TEMPORARY STRUCTURE formed of plurality of panels each having rod formations along certain edges thereof. A plurality of elongated joining devices define slots which receive the supporting rods for the panels. Connectors are utilized for receiving the respective end portions of the frame members in a interconnecting manner to form a combined structure of closure.

U.S. Pat. No. 5,647,181 issued to Hunts and U.S. Pat. No. 5,470,139 issued to Hsiao, each set forth multiply slotted structural connectors utilized in forming combined structures having a plurality of planar elements therein.

Additional structural elements for fabricating various structures such as enclosures or display cases are set forth in U.S. Pat. Nos. 5,472,365 issued to Angle; 4,557,091 issued to Auer; 1,818,404 issued to Kaufman; 6,283,456B1 issued to Benz et al.; 5,222,902 issued to Piersch and 4,291,512 issued to Walton.

Finally, U.S. Pat. No. 5,357,761 issued to Schauer and U.S. Pat. No. 6,176,953B1 issued to Landreth et al. each set forth methods for joining plastic material.

Despite the substantial development of construction toy sets such as those described above and the related structures found in other arts also set forth above, construction toy sets remain limited by the need for balancing competing needs of simplicity and ease of assembly or disassembly on the one hand and strength and rigidity of the assembled structures on the other hand. For the most part, construction toy sets are designed to provide characteristics which are, in effect, designed compromise between these competing needs. The need for ease and simplicity of assembly or disassembly is particularly acute in construction toy sets intended for use with younger children.

There arises therefore a continuing need in art for ever-more improved construction toy sets. A more particular need arises for construction toy sets having ease of assembly or disassembly together with security and strength of fabricated structures.

SUMMARY OF THE INVENTION

Accordingly, it is a general object of the present invention to provide an improved construction toy set. It is a more particular object of the present invention to provide an improved construction toy set which is particularly adapted for use by younger children. It is a still more particular object of the present invention to provide an improved construction toy set which facilitates ease of insertion or low insertion force between the structural elements and connecting elements while simultaneously providing relatively rigid and secure fabricated structures.

In accordance with the present invention there is provided a construction toy set comprising: a plurality of connecting bodies each defining a three-dimensional body having an outer surface and a plurality of slots each extending inwardly from the outer surface and each terminating within the body in an enlarged undercut portion; and a plurality of generally planar plate members each having opposed surfaces and outer edges, the edges being configured and sized to be inserted into selected ones of the slots, the bodies being formed of a resilient material such that the slots deform elastically when one of the edges is inserted into one of the slots to secure the connecting body to the plate member, combinations of the plate members being joined by the connecting bodies to form toy structures.

In accordance with an alternative view of the present invention, there is provided a construction toy set comprising: a plurality of connecting bodies each defining a three-dimensional body having an outer surface, a passage through the three-dimensional body and a plurality of slots each extending inwardly from the outer surface and each terminating within the body in an enlarged undercut portion; a plurality of generally planar plate members each having opposed surfaces and outer edges, the edges including edge portions configured and sized to be inserted into selected ones of the slots; a head member having a face portion, a passage and an interior cavity for receiving a portion of a selected one of the connecting bodies; and an elongated rod sized to fit within the passages, the bodies being formed of a resilient material such that the slots deform elastically when one of the edge portions is inserted into one of the slots to secure the connecting body to the plate member, combinations of the plate members being joined by the connecting bodies to form portions of toy figures including appendages, the connecting bodies being stacked in a vertical array with the rod passing through the passages and the head member being received upon the uppermost one of the connecting bodies.

In accordance with a still further alternate perspective of the present invention, there is provided a construction toy set comprising: a plurality of connecting bodies each defining a three-dimensional body having an outer surface and a plurality of slots each extending inwardly from the outer surface and each of the slots terminating within the body in an enlarged undercut portion, the slots each further including a pair of resilient flexible ribs having interior surfaces forming interior sides of the slot and a pair of relief slots adjacent each of the flexible ribs, the relief slots providing clearance between the ribs and the surrounding portions of the body to facilitate flexing of said ribs; and a plurality of generally planar plate members each having opposed surfaces and outer edges, the edges being configured and sized to be inserted into selected ones of the slots, the body being formed of a resilient material such that the slots deform elastically by flexing of the ribs when one of the edges is inserted into one of the slots to secure the connecting body to the plate member, combinations of the plate members being joined by the connecting bodies to form toy structures.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 26:
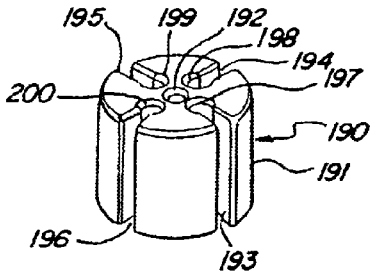
FIG. 26 sets forth a perspective view of a cylindrical connecting body constructed in accordance with the present invention.
Figure 27:
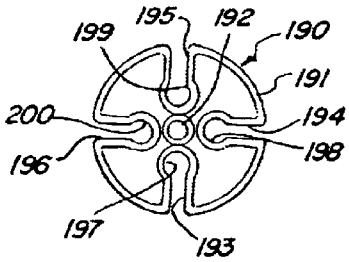
FIG. 27 sets forth a top view of the connecting body shown in FIG. 26.
Figure 29:
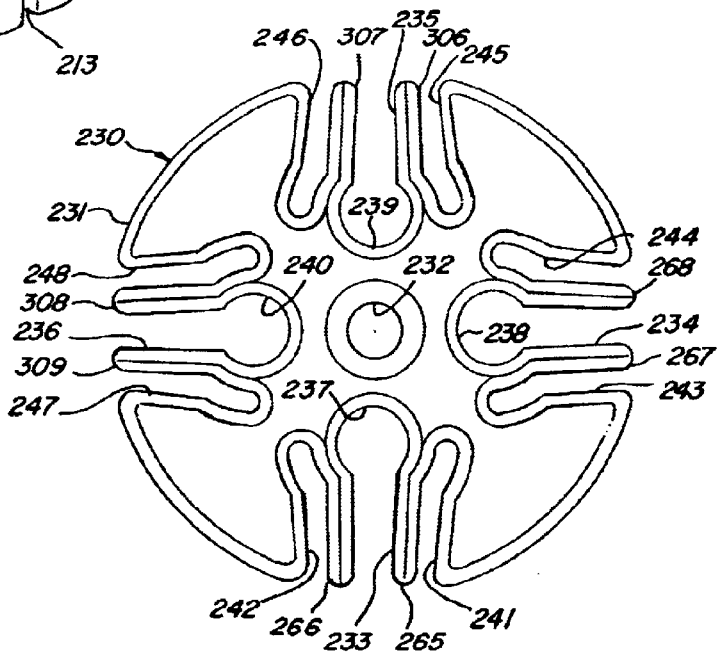
FIG. 29 sets forth a top view of an alternate generally cylindrical connecting body constructed in accordance with the present invention.
Figure 30:
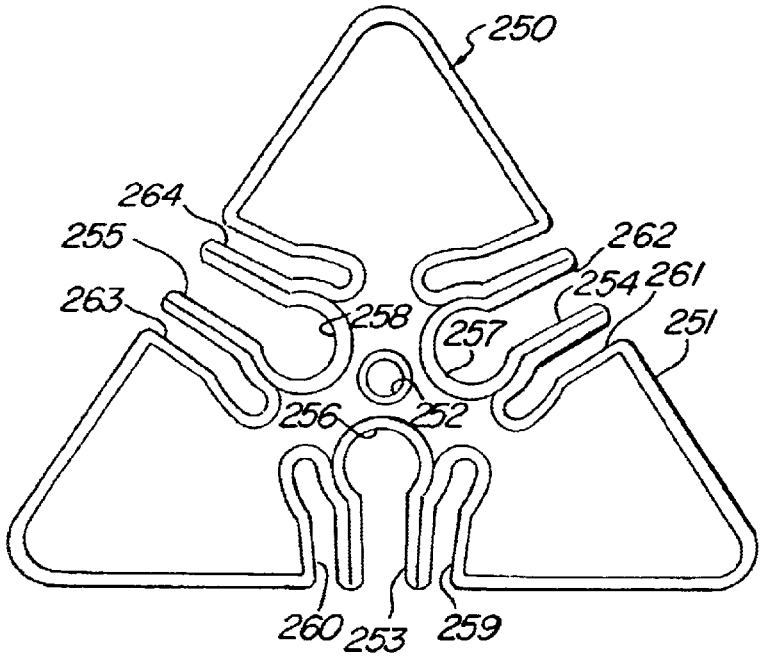
FIG. 30 sets forth a top view of a triangular connecting body constructed in accordance with the present invention.
Figure 31:
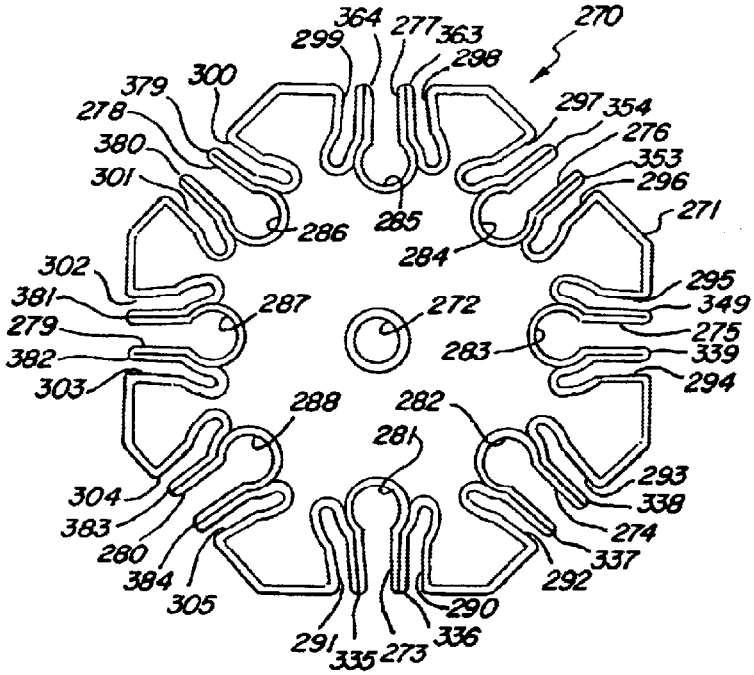
FIG. 31 sets forth a top view of an octagonal connecting body constructed in accordance with the present invention.
Figure 48:
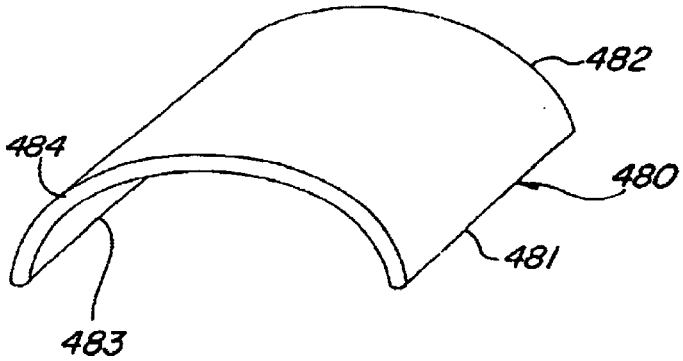
FIG. 48 sets forth a perspective view of an alternate plate member defining a generally semi-cylindrical shape and constructed in accordance with the present invention.
Figure 49:
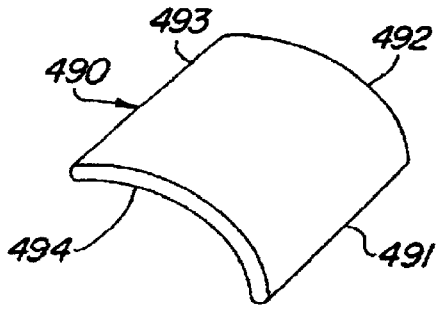
FIG. 49 sets forth a perspective view of a further alternate plate member constructed in accordance with the present invention and defining a generally one-quarter cylindrical shape.

By way of overview, the descriptive material set forth below in conjunction with FIGS. 1 through 58 sets forth various elements of the present invention construction toy set alone and in combination. The present invention construction toy set includes a plurality of variously shaped somewhat resilient connecting bodies each defining one or more slots which receive generally planar elements and members. The connecting bodies may be fabricated in virtually any solid shape and are shown by way of example as defining spherical shapes in FIGS. 1 through 4 and 7 through 14. Further example is found in rectangular and cubic shaped connecting bodies shown in FIGS. 15 through 25 while cylindrically shaped connecting bodies are illustrated in FIGS. 26, 27 and 29. A generally nondescript shaped connecting body is shown by way of further example in FIG. 28. A connecting body defining a triangular prism is shown in FIG. 30 while a connecting body defining an octagonal prism is illustrated in FIG. 31. Various examples of differently shaped connecting plates and members are shown in FIGS. 32 through 47 while curved members and plates are shown in FIGS. 48 and 49.

Figure 56:
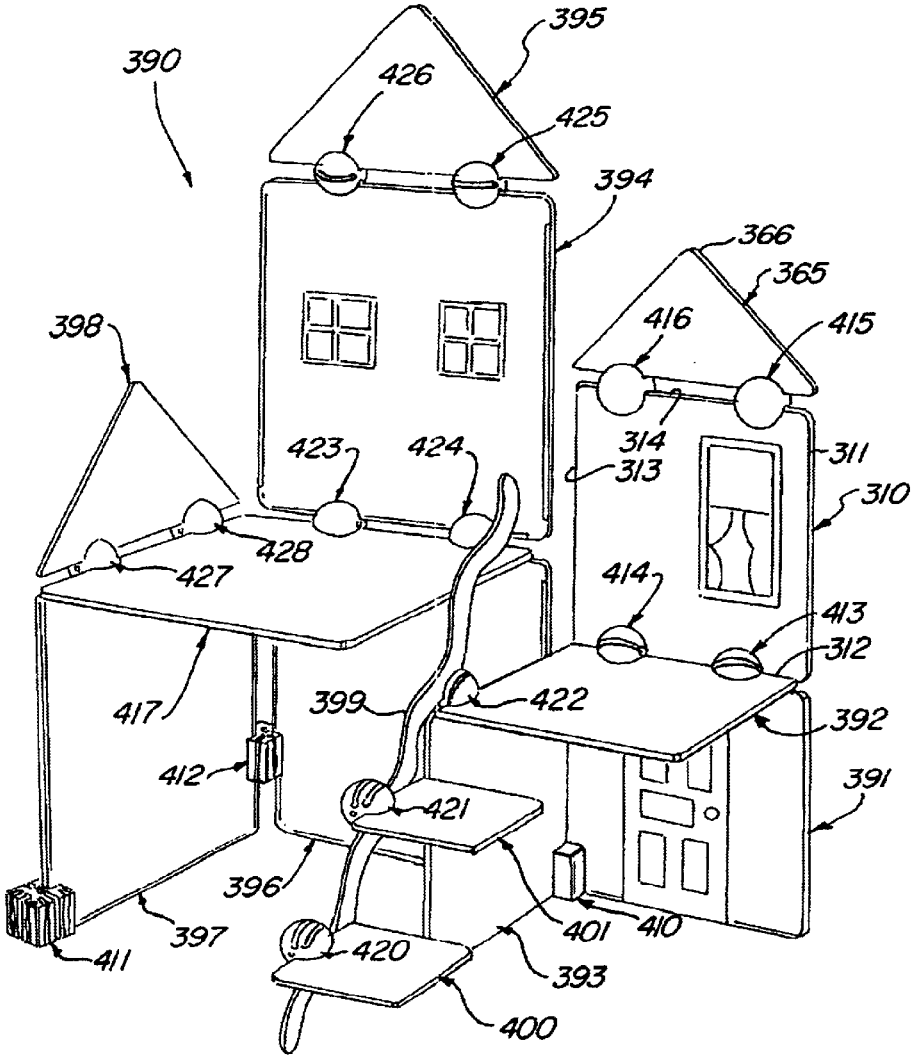
FIG. 56 sets forth a perspective view of a typical complex structure fabricated utilizing the present invention construction toy set.
Figure 57:
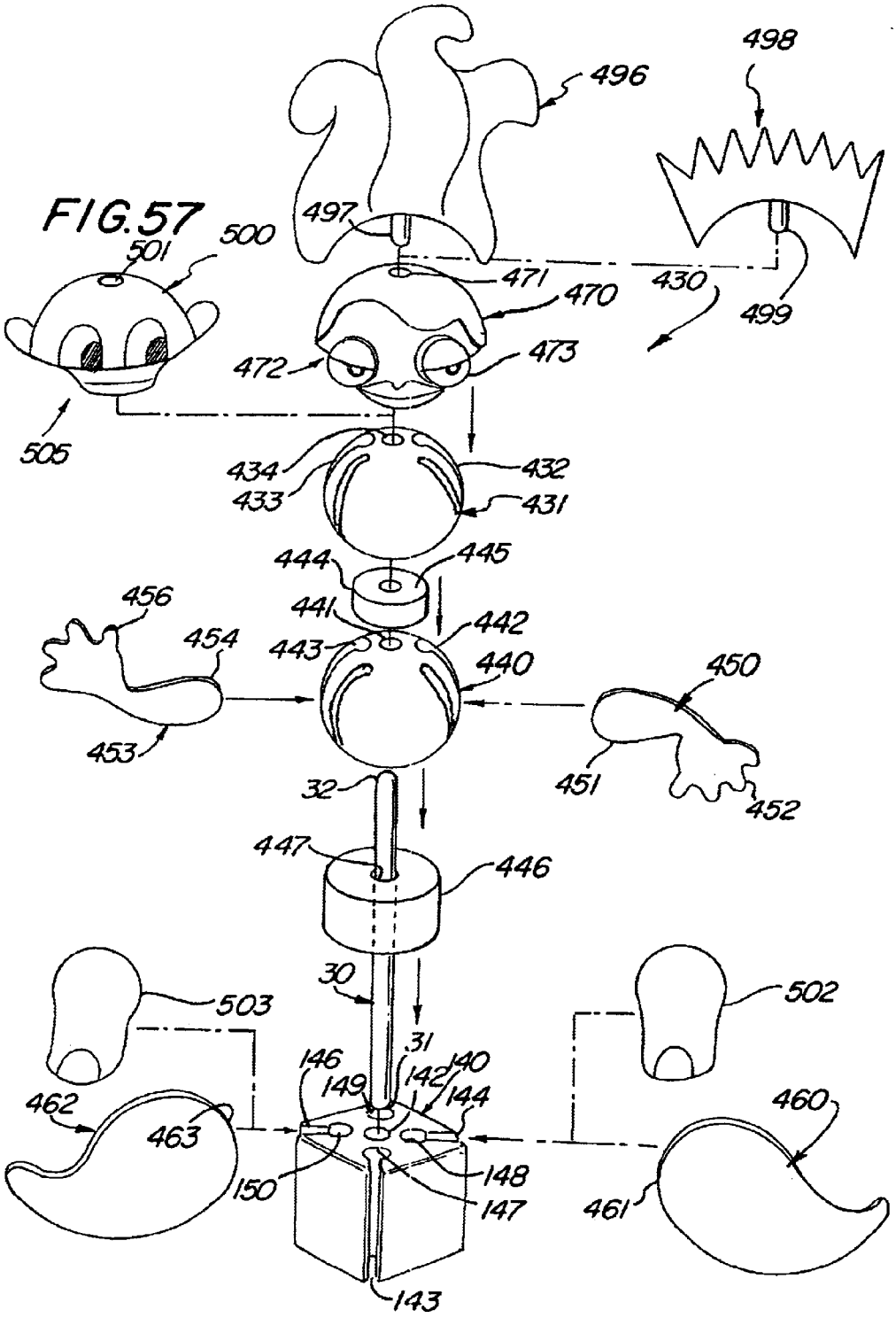
FIG. 57 sets forth a perspective assembly view of a typical figure fabricated and constructed in accordance with the present invention construction toy set.

The plates and members may be joined to form more elaborate structures using the connecting bodies. Basic assembly is provided by insertion of the edges of the plates or members into the connecting body slots. The novel gripping mechanisms operable within the connecting body slots upon the edge portions of the plates and planar members provide simultaneous-ease of insertion and reliable secure attachment in accordance with an important aspect of the present invention. Examples of the insertion and attachment mechanisms thus provided are shown in FIGS. 50 through 55. FIG. 56 sets forth an example of a somewhat elaborate fabricated constructed using the present invention construction toy set while a representative example of a toy figure structure also constructed utilizing the present invention construction toy set is shown in FIGS. 57 and 58.

Figure 1:
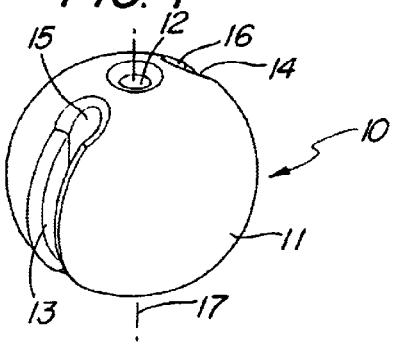
FIG. 1 sets forth a perspective view of a spherical connecting body constructed in accordance with the present invention.

More specifically, FIG. 1 sets forth a perspective view of a spherically shaped connecting body constructed in accordance with the present invention and generally referenced by numeral 10. Connecting body 10 is preferably formed of a somewhat resilient material and defines an outer surface 11 together with a passage 12. Passage 12 extends entirely through connecting body 10 and defines an axis 17 of spherically shaped connecting body 10. Connecting body 10 further defines a slot 13 extending inwardly from surface 11 and terminating in an internal oversized undercut portion 15. Connecting body 10 further defines a second slot 14 positioned oppositely from slot 13 and extending inwardly from surface 11. An undercut 16 is formed at the interior portion of slot 14. In accordance with the fabrication method set forth below, slots 13 and 14 are utilized in receiving the edge portions of connecting plates such as plate 310 shown in FIG. 32 in a secure insertion. Undercuts 15 and 16 cooperate during plate insertion to provide for flexing of connecting body 10 to accommodate the plate insertion. The fabrication method of the present invention construction set is set forth below in FIGS. 50 through 55 in greater detail. However, suffice it to note here, that the resilient material from which connecting body 10 is formed together with the structures of slots 13 and 14 and undercut portions 15 and 16 cooperate to facilitate secure attachment with ease of insertion and a minimum of insertion force. Additionally, passage 12 is utilized in receiving an elongated rod such as rod 30 shown in FIG. 6 to provide further structural fabrication accommodating elements such as fabricated toy FIG. 430 shown in FIG. 57.

Figure 2:
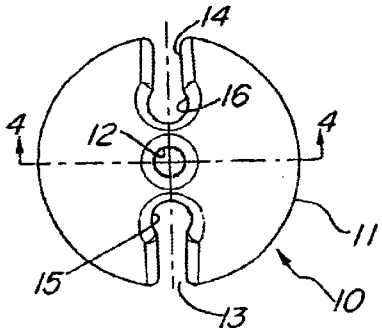
FIG. 2 sets forth a top view of the spherical connecting body of FIG. 1.

FIG. 2 sets forth a top view of connecting body 10 showing a spherical outer surface 11 having a passage 12 extending downwardly therethrough. Connecting body 10 further defines a pair of opposed inwardly extending slots 13 and 14 each terminating in interior undercut portions 15 and 16.

Figure 3:
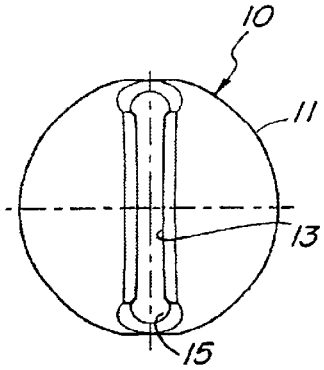
FIG. 3 sets forth a side view of the spherical connecting body of FIG. 1.

FIG. 3 sets forth a side elevation view of connecting body 10 showing spherical surface 11 and slot 13 having undercut 15 formed therein.

Figure 4:
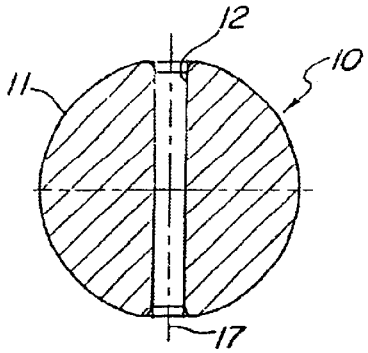
FIG. 4 sets forth a section view of the spherical connecting body of FIG. 2 taken along 2—2 therein.

FIG. 4 sets forth a section view of connecting body 10 taken along 4—4 in FIG. 2. As described above, connecting body 10 defines a generally spherical outer surface and a passage 12 extending along major axis 17 of the connecting body. In the preferred fabrication of the present invention, connecting body 10 is shown of a single molded solid body of material. The material selected for connecting body 10 is chosen to provide sufficient rigidity and strength to support a portion of a combined structure of which connecting body 10 might form a portion such as the fabricated structure shown in FIG. 56. Additionally, the material from which connecting body 10 is fabricated is also preferably sufficiently resilient to provide the above described deformation necessary to receive an inserted plate member within the connecting body slots.

Figure 5:
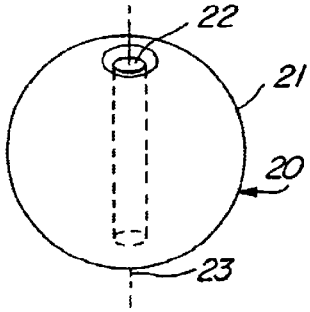
FIG. 5 sets forth a perspective view of an alternate spherical connecting body constructed in accordance with the present invention.

FIG. 5 sets forth a perspective view of an alternative spherical connecting body generally referenced by numeral 20. Connecting body 20 differs from connecting body 10 in that it omits slots 13 and 14. Thus, connecting body 20 provides a generally continuous outer surface 21 together with a defined axially passage 22 extending through major axis 23. The functionally operation of a connecting body such as connecting body 20 is limited to the insertion of a suitable element such as rod 30 (seen in FIG. 6) into or through passage 22.

Figure 6:
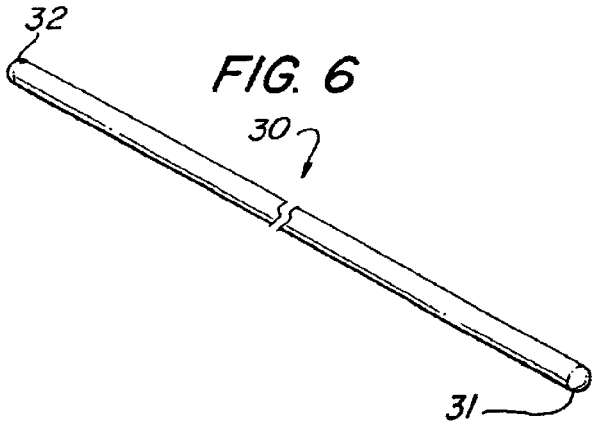
FIG. 6 sets forth a perspective view an elongated rod constructed in accordance with the present invention.

FIG. 6 sets forth a perspective view of an elongated generally cylindrical rod 30 having end portions 31 and 32. Rod 30 may be utilized in the present invention construction toy set to fabricate portions of structures in the manner set forth below in FIG. 57.

Figure 7:
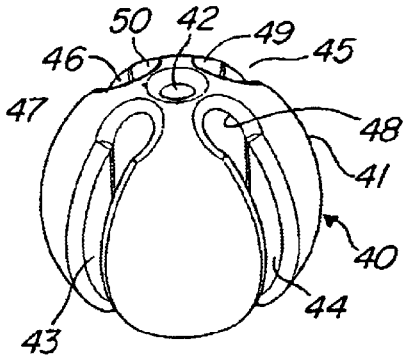
FIG. 7 sets forth a perspective view of a still further spherical connecting body constructed in accordance with the present invention.

FIG. 7 sets forth a perspective view of a still further alternate fabrication of a connecting body constructed in accordance with the present invention and generally referenced by numeral 40. Connecting body 40 is generally similar to connecting body 10 with the primary difference being found in the provision of four radially extending slots rather than the two opposed slots shown in connecting body 10. Thus, connecting body 40 defines a generally spherical outer surface 41 and a passage 42 extending through the connecting body. A plurality of radially extending slots 43 and 44, 45 and 46 extend inwardly from spherical surface 41 and terminate in respective enlarged undercut portions 47, 48, 49 and 50. The fabrication of connecting body 40 is again preferably formed of a somewhat resilient material such as molded plastic or the like. The operation of slots 43 through 46 is also utilized in receiving one or more planar members or plates in the fabrication of more complex structures. Passage 42 serves the purpose of receiving all or a portion of a cylindrical member such as rod 30 (seen in FIG. 6).

Figure 8:
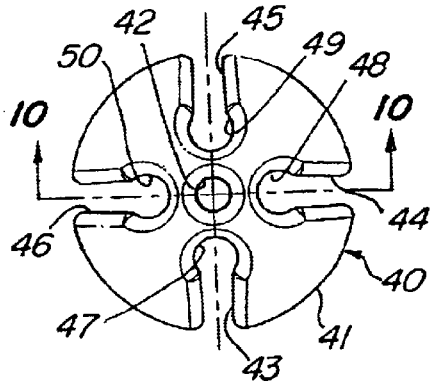
FIG. 8 sets forth a top view of the spherical connecting body shown in FIG. 7.

FIG. 8 sets forth a top view of connecting body 40 showing spherical surface 41 together with inwardly extending slots 43 through 46 each of which defines respective enlarged undercut portions 47 through 50. A passage 42 extends through connecting body 40.

Figure 9:
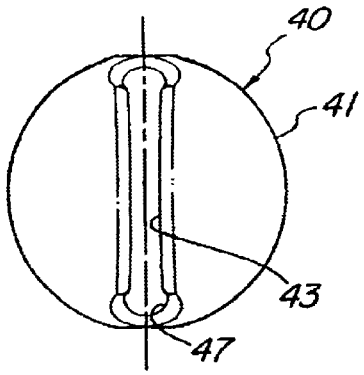
FIG. 9 sets forth a side view of the spherical connecting body of FIG. 7.

FIG. 9 sets forth a side elevation view of connecting body 40 showing spherical outer shape 41 and inwardly extending slot 43. Slot 43 terminates in an enlarged undercut portion 47.

Figure 10:
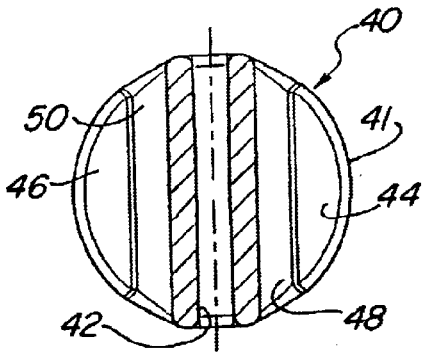
FIG. 10 sets forth a section view of the spherical connecting body of FIG. 8 taken along section lines 10—10 therein.

FIG. 10 sets forth a section view of body 40 taken along section lines 10—10 in FIG. 8. As described above, connecting body 40 defines a generally spherical outer surface 41 together with a passage 42 extending through the entirety of the connecting body. Connecting body 40 further defines a plurality of inwardly extending slots such as slots 44 and 46 which in turn terminate in enlarged undercut portions 48 and 50.

It will be apparent by comparison of connecting body 40 and connecting body 10 (seen in FIG. 1) that the substantial difference found between the connecting bodies is the ability of connecting body 40 to accommodate a total of four inserted plate members while connecting body 10 is suitable for receiving a pair of plate members. In each case however, it will be apparent that the coupling mechanism is virtually the same and is found in the combination of the material resilience and strength characteristics together with the physical structure of the slot and undercut portions.

Figure 11:
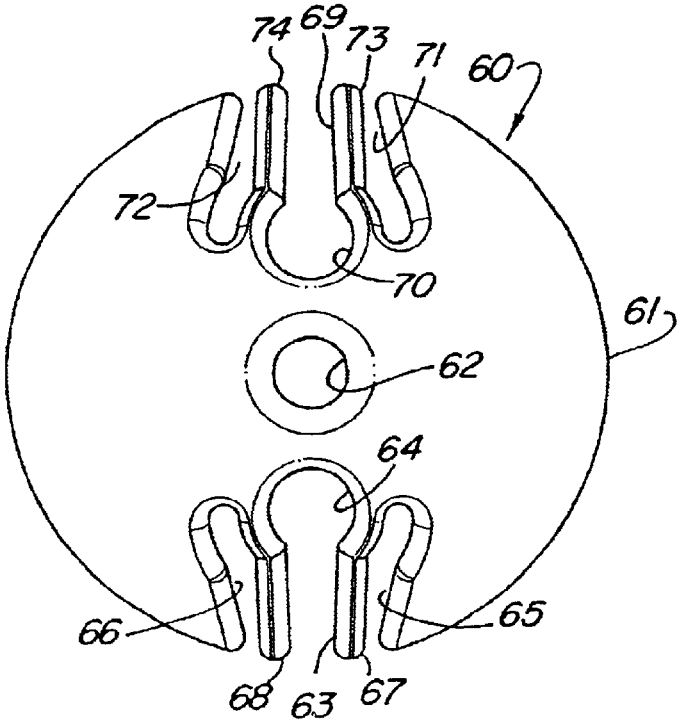
FIG. 11 sets forth a top view of still further alternate spherical connecting body constructed in accordance with the present invention.

FIG. 11 sets forth a top view of a still further alternate fabrication of a connecting body generally referenced by numeral 60. Connecting body 60 is similar to connecting bodies 10 and 40 (seen in FIGS. 1 and 7) in that it provides a generally spherical surface 61 and an axially passage 62 extending through the entirety of the connecting body. Connecting body 60 differs from connecting bodies 10 and 40 described above however in the provision of a further improved slot structure. The slot structure provided in body 60 utilizes a novel undercut and rib combination to enhance the gripping and strength characteristics of the connecting body. Once again, connecting body 60 is preferably formed of a somewhat rigid and somewhat resilient material such as molded plastic or the like.

Connecting body 60 includes a pair of opposed inwardly extending slots 63 and 69 which terminate in respective enlarged undercuts 64 and 70. Additionally, slot 63 defines a pair of relief slots 65 and 66 on either side of slot 63 which combined with slot 63 to form a pair of ribs 67 and 68. Ribs 67 and 68 together with undercut 64 cooperate with relief slots 65 and 66 to provide flexible attachment for the edge portion of a connecting plate in the manner set forth below in FIGS. 54 and 55. Suffice it to note here, that ribs 67 and 68 are able to flex outwardly due to the provision of relief slots 65 and 66 without deformation of the remainder of connecting body 60.

Similarly, slot 69 terminates an enlarged undercut 70 and includes relief slots 71 and 72 on each side of slot 69. A pair of flexible connecting ribs 73 and 74 is thereby formed. Once again ribs 73 and 74 are capable of flexing due to the presence of relief slots 71 and 72 without causing substantial deformation of the remainder of connecting body 60. Once again, this connecting mechanism is set forth below in FIGS. 54 and 55 in greater detail. However, suffice it to note here, that the edge portion of a plate member may be inserted into either slot 63 or slot 69 without deforming the remainder of connecting body 60. Stated otherwise, this means that the insertion of a plate member edge within slot 63 is not influenced in its insertion force by the presence or absence of a corresponding edge portion of a plate member within slot 69. In this manner, the insertion force for slots 63 and 69 remains substantially uniform regardless of the presence of other plate members within the connecting body. This is particularly important in connecting bodies such as connecting body 80 shown in FIG. 13 which utilize a greater plurality of connecting slots and thereby accommodate a greater number of plate members.

Figure 12:
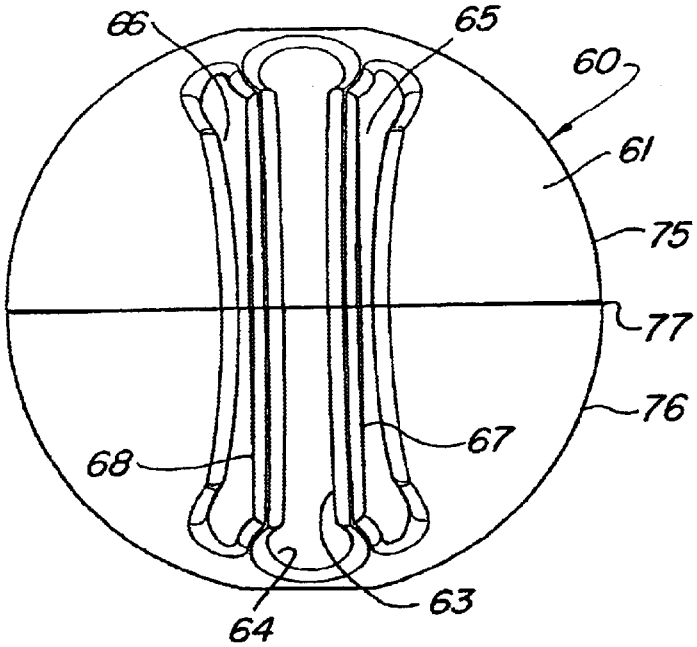
FIG. 12 sets forth a side view of the spherical connecting body of FIG. 11.

FIG. 12 sets forth a side view of connecting body 60. To ease the fabrication of connecting body 60, the connecting body is fabricated of a pair of hemispherical half portion 75 and 76 which are separately formed and thereafter joined along a seam 77. Hemispherical portion 75 and 76 may be joined utilizing various known manufacturing methods. One example of one such attachment is set forth below in FIG. 14, which is illustrative of a fabrication method which utilizes sonic welding to secure the half portions. Alternatively, half portions 75 and 76 may be joined utilizing other fabrication method such as adhesive attachment or the like. The important aspect with respect to the present invention is the resulting formation of the generally spherical connecting body. As described above, connecting body 60 defines a slot 63 terminating an enlarged undercut 64. As is also described above, a pair of relief slots 65 and 66 are formed on either side of slot 63 to produce flexible ribs 67 and 68.

Figure 13:
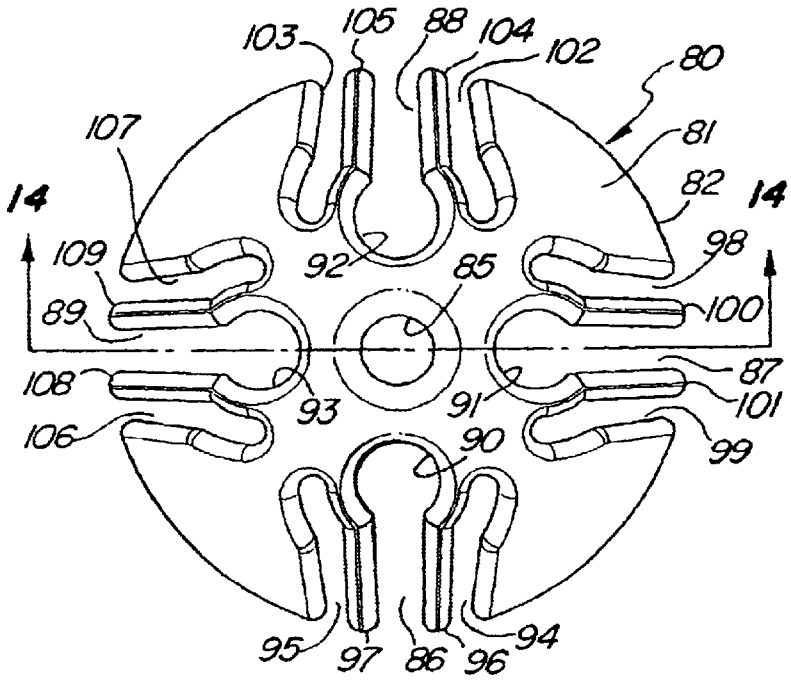
FIG. 13 sets forth a still further alternate spherical connecting body constructed in accordance with the present invention.

FIG. 13 sets forth a top view of a still further alternate connecting body constructed in accordance with the present invention and generally referenced by numeral 80. Connecting body 80 defines a generally spherical outer surface 81 together with a passage 85 extending downwardly through the entirety of connecting body 80. Connecting body 80 further defines a plurality of inwardly extending slots 86, 87, 88 and 89. Slots 86 through 89 terminate in respective enlarged undercuts 90 through 93. A pair of relief slots 94 and 95 are formed on either side of slot 86 to form a pair of flexible ribs 96 and 97. Similarly, a pair of relief slots 98 and 99 are formed on each side of slot 87 to form a pair of flexible ribs 100 and 101. A pair of relief slots 102 and 103 are formed on each side of slot 88 to form flexible ribs 104 and 105 while a pair of relief slots 106 and 107 are formed on each side of slot 89 to form flexible ribs 108 and 109.

As mentioned above, the connecting mechanism provided by the combination of inwardly extending slots, relief slots, and flexible ribs shown in connecting bodies such as connecting body 80 is set forth below in FIGS. 54 and 55 in greater detail. However, suffice it to note here that as is also mentioned above, the provision of flexible ribs on each side of the connecting slot allows the flexing of the slot to accommodate insertion of the edge portion of a plate member without causing the deformation of the remainder of the connecting body. Thus, connecting body 80 generally retains its spherical shape regardless of whether one or more plate members are inserted into one or more connecting slots in fabricating a more complex structure. This in turn yields a very important advantage of the present invention structure by which the insertion force necessary to insert the edge portion of a plate member into a given slot remains relatively constant regardless of whether the remaining slots are empty or have already received an inserted plate member. This in turn provides a more reliable insertion force which accommodates younger children and allows the fabricator of the present invention construction toy set to more accurately and consistently provide the desired insertion force characteristics for the connecting body and plate members.

Figure 14:
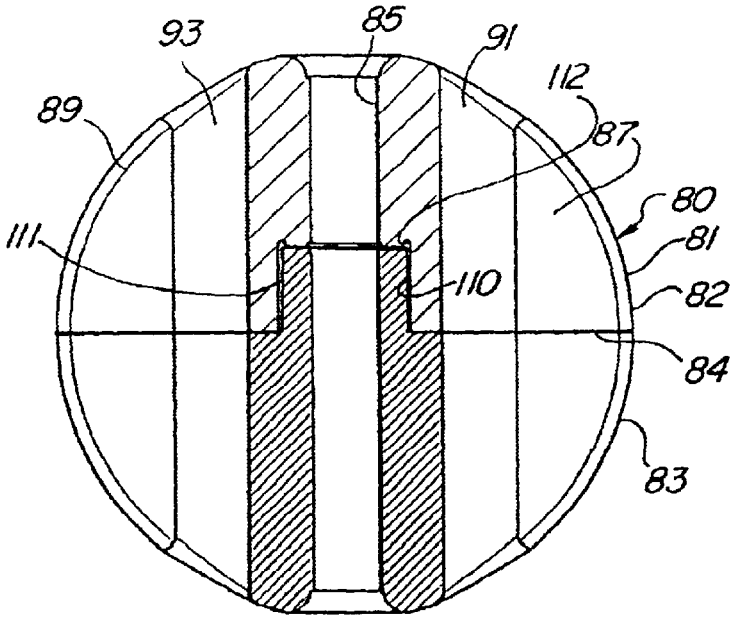
FIG. 14 sets forth a section view of the spherical connecting body of FIG. 13 taken along section lines 14—14 therein.

FIG. 14 sets forth a section view of connecting body 80 taken along section lines 14—14 in FIG. 13. As described above, connecting body 80 is generally spherical in shape and thus defines a generally spherical outer surface 81. In similarity to connecting body 60 set forth above in FIG. 12, connecting body 80 is formed of a pair of generally symmetrical hemispherical portions 82 and 83. Hemispherical portions 82 and 83 meet along a seam 84 and are secured utilizing ultrasonic welding or other fabrication techniques. Hemispherical portion 82 defines a recess 110 while hemispherical portion 83 defines a correspondingly shaped boss 111. Boss 111 and recess 110 are configured and shaped to provide the nesting attachment shown in FIG. 14. Because ultrasonic welding is used in securing half portions 82 and 83, an energy concentrator 112 fabricated in accordance with conventional fabrication techniques is formed upon boss 111 to facilitate this attachment. The remainder of connecting body 80 is includes a passage 85 extending through the entire connecting body together with inwardly extending slots 87 and 89 terminating in respective undercut portions 91 and 93.

Figure 15:
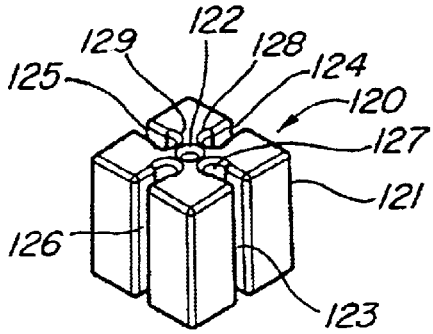
FIG. 15 sets forth a perspective view of a cubical connecting body constructed in accordance with the present invention.

FIG. 15 sets forth a perspective view of a still further alternate connecting body constructed in accordance with the present invention and generally referenced by numeral 120. Connecting body 120 defines a generally cubical body 121 having a passage 122 extending downwardly through the entirety of body 121. Body 121 further defines a plurality of inwardly extending slots 123, 124, 125 and 126 terminating in respective enlarged undercuts 127, 128, 129 and 130. Slots 123 through 126 correspond generally to slots 43 through 46 of connecting body 40 (seen in FIG. 8). Thus, slots 123 through 126 may be utilized in receiving the edge portions of plate members in the manner set forth below in FIGS. 50 through 53. In addition, passage 122 is utilized in receiving an elongated cylindrical member such as rod 30 seen in FIG. 6. In its preferred fabrication, body 121 is formed of a somewhat resilient rigid material such as molded plastic or the like. It will be noted that apart from the cubic shape of body 121, connecting body 120 functions in substantially the same manner as the spherically shaped body set forth above in greater detail. In addition, illustration of the use of connecting bodies such as connecting body 120 is set forth below in FIGS. 56 and 57.

Figure 16:
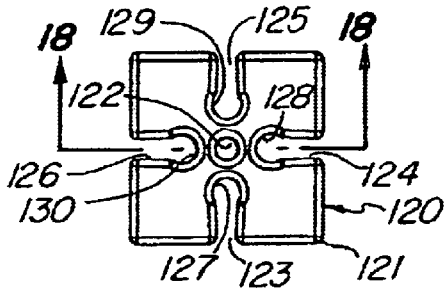
FIG. 16 sets forth a top view of the connecting body of FIG. 15.
Figure 17:
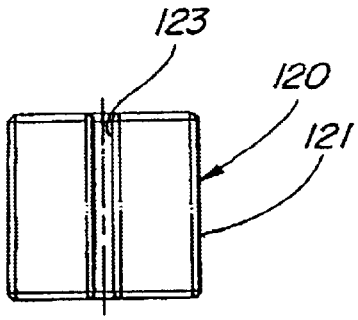
FIG. 17 sets forth a side view of the connecting body of FIG. 15.

FIG. 16 sets forth a top view of connecting body 120. As described above, connecting body 120 defines a generally cubic body 121 formed of a suitable molded plastic material or the like. In addition, as is also described above, body 121 defines inwardly extending slots 123 through 126 each terminating in enlarged undercut portions 127 through 130. As described above, enlarged undercuts such as undercuts 127 through 130 facilitate the insertion of the edge portions of plate members into slots 123 through 126. Basically, the enlarged dimension of enlarged undercuts 127 through 130 facilitates the flexing of body 121 as the surfaces of notches 123 through 126 are forced outwardly by plate member insertion. In addition, and as is better set forth below in FIGS. 50 through 53, the enlarged dimensions of the undercut portions facilitate additional attachment security in cooperation with various edge structures of the plate members. FIG. 17 sets forth a side elevation view of connecting body 120. As described above, connecting body 120 includes a cubic body 121 preferably formed of a molded plastic material or the like which defines a plurality of inwardly extending slots such as slot 123 shown in FIG. 17.

Figure 18:
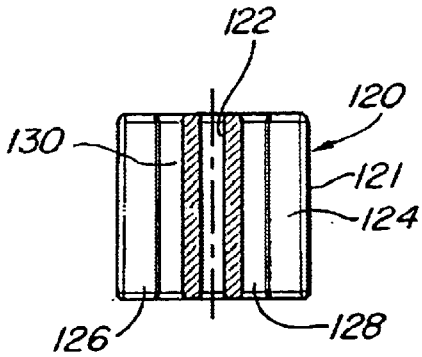
FIG. 18 sets forth a section view of the cubic body shown in FIG. 16 taken along section lines 18—18 therein.

FIG. 18 sets forth a section view of connecting body 120 taken along section lines 18—18 in FIG. 16. Connecting body 120 describes a generally cubic shape and thus includes a cubic body 121 preferably formed of a molded plastic material or the like. Connecting body 120 includes inwardly extending slots 124 and 126 terminating in respective enlarged undercut portions 128 and 130. In addition, connecting body 120 includes a passage 122 extending through cubic body 121. It will be recalled that passage 122 is preferably sized to receive a portion of an elongated rod such as rod 30 seen in FIG. 6.

Figure 19:
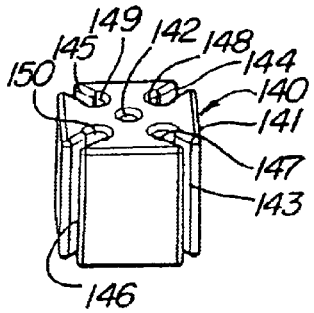
FIG. 19 sets forth a perspective view of an alternate cubic connecting body constructed in accordance with the present invention.

FIG. 19 sets forth a perspective view of a still further alternate connecting body constructed in accordance with the present invention and generally referenced by numeral 140. Connecting body 140 is generally cubic in shape and differs from connecting body 120 (seen in FIG. 15) in that the plurality of inwardly extending slots formed therein is oriented to correspond to the diagonal of the cubic body. More specifically, connecting body 140 includes a cubic body 141 preferably formed of a molded plastic material or the like which defines a downwardly extending passage 142 therein. At the corner portions of cubic body 141, a corresponding plurality of inwardly extending slots 143, 144, 145 and 146 are formed. Slots 143 through 146 terminate in enlarged undercut portions 147, 148, 149 and 150 respectively.

Figure 20:
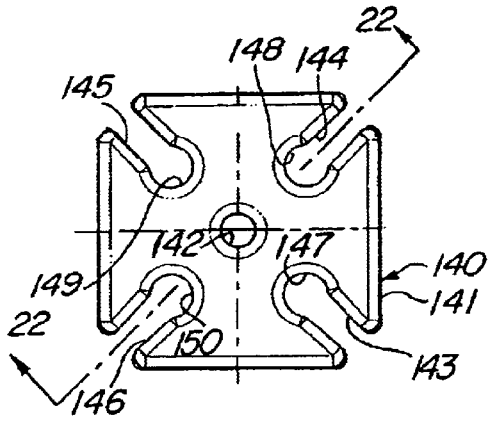
FIG. 20 sets forth a top view of connecting body of FIG. 19.

FIG. 20 sets forth a top view of connecting body 140. As described above, connecting body 140 includes a molded plastic cubic body 141 having a downwardly extending passage 142 formed therein. Extending inwardly from each of the corners of cubic body 141 is a plurality of slots 143, 144, 145 and 146. Slots 143 through 146 terminate in enlarged undercut portions 147 through 150 respectively. As mentioned above, cubic body 141 is preferably formed of a somewhat resilient molded plastic material or the like.

Figure 21:
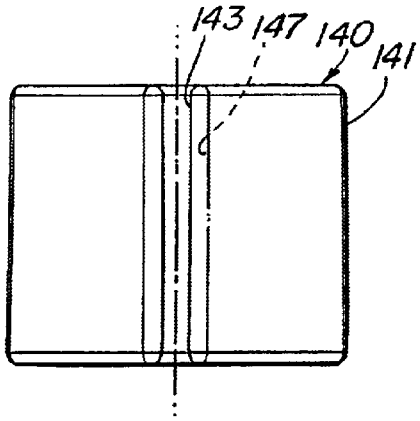
FIG. 21 sets forth a side view of the connecting body of FIG. 19.

FIG. 21 sets forth a side elevation view of connecting body 140, having a cubic body 141 defining a slot 143 therein. Slot 143 terminates in an enlarged undercut portion 147.

Figure 22:
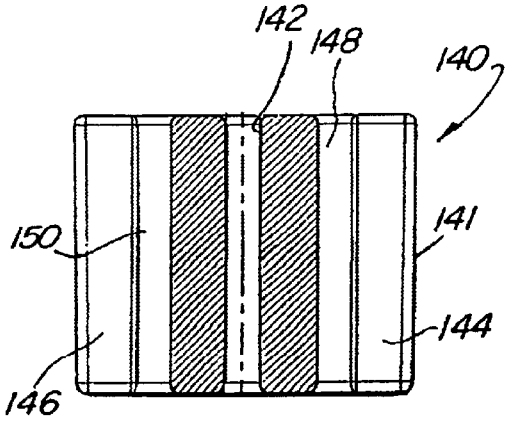
FIG. 22 sets forth a section view of the connecting body of FIG. 20 taken along section lines 22—22 therein.

FIG. 22 sets forth a section view of connecting body 140 taken along section lines 22—22 in FIG. 20. As described above, connecting body 140 defines a cubic body 141 preferably formed of a molded plastic resilient material or the like. Cubic body 141 defines a passage 142 is extending therethrough together with a plurality of inwardly extending slots such as slots 144 and 146. Slots 144 and 146 terminate in enlarged undercut portions 148 and 150. The attachment of the edge portions of plate members within the slots of connecting body 140 is illustrated in FIGS. 50 through 53. Suffice it to note here that the resilience of cubic body 141 together with the structure of inwardly extending slots and enlarged undercut portions facilitates this insertion and provides a securing force upon an inserted plate member.

Figure 23:
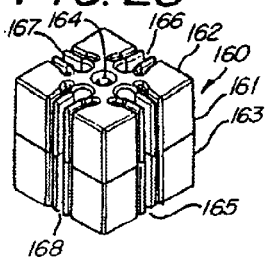
FIG. 23 sets forth a perspective view of a still further alternate connecting body constructed in accordance with the present invention.

FIG. 23 sets forth a perspective view of a still further alternate connecting body constructed in accordance with the present invention and generally referenced by numeral 160. Connecting body 160 is similar in its cubic shape to connecting body 120 (seen in FIG. 15) with the addition of an improved slot structure. Connecting body 160 includes a cubic body 161 formed of half portions 162 and 163. A plurality of inwardly extending slots 165, 166, 167 and 168 are formed in cubic body 161. The structure of slots 165 through 168 is set forth below in FIG. 24 in greater detail. However, suffice it to note here, that slots 165 through 168 utilize an improved slot structure similar and analogous to the structure of slots 86 through 89 in the spherical embodiment of the present invention shown in FIG. 13. This improved structure facilitates insertion of the edge portions of plate members into each slot without causing deformation of the remainder of cubic body 161.

Figure 24:
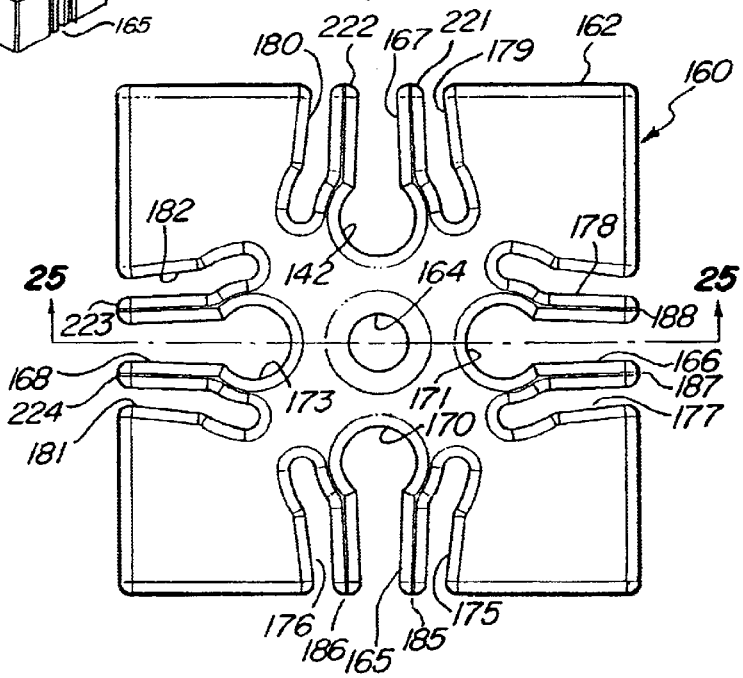
FIG. 24 sets forth a top view of the connecting body shown in FIG. 23.

FIG. 24 sets forth a top view of connecting body 160. Connecting body 160 is formed of half portions 162 and 163 (seen in FIG. 23) secured in the manner set forth below in FIG. 25. Connecting body 160 defines a passage 164 extending downwardly through half portions 162 and 163. In addition, connecting body 160 defines a plurality of inwardly extending slots 165, 166, 167 and 168. Slots 165 through 168 terminate in enlarged undercut portions 170 through 173 respectively. A pair of relief slots 175 and 176 are formed on each side of slot 165 to define flexible ribs 185 and 186. Similarly, a pair of relief slots 177 and 178 are formed on each side of slot 166 to form flexible ribs 187 and 188. In a similar fashion, a pair of relief slots 179 and 180 are formed on each side of slot 167 to form flexible ribs 221 and 222 while a pair of relief slots 181 and 182 are formed on each side of slot 168 to form flexible ribs 223 and 224. The resulting structure of connecting body 160 functions in substantially the same manner as connecting body 80 set forth above in FIG. 13 in that a plurality of edge portions of plate members such as plate member 310 seen in FIG. 32 may be inserted into any or all of slots 165 through 168 without causing significant deformation of the remainder of connecting body 160. The operation of the flexible ribs adjacent each slot is set forth below in FIGS. 54 and 55 in greater detail. However, suffice it to note here that in each slot the flexible rib pairs are capable of flexing outwardly to receive the edge portions of inserted plate members and to provide a maintaining force thereupon. It is important to note that this flexing the flexible rib pair adjacent each slot does not deform the remainder of connecting body 160.

Figure 25:
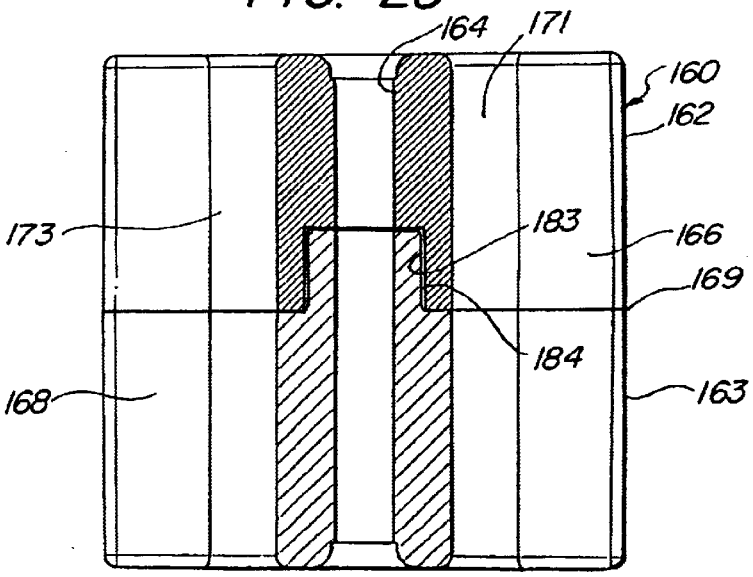
FIG. 25 sets forth a section view of the connecting body shown in FIG. 24 taken along section lines 25—25 therein.

FIG. 25 sets forth a section view of connecting body 160 taken along section lines 25—25 of FIG. 24. Connecting body 160 is formed of half portions 162 and 163 joined along a common seam 169 to form a cubic body. Half portion 162 defines a recess 183 while half portions 163 defines a correspondingly shaped and sized boss 184 received therein. Attachment between half portions 162 and 163 may be secured utilizing ultrasonic welding or other well known attachment apparatus such as adhesive or chemical bonding or the like. Connecting body 160 defines a passage 164 extending therethrough together with a plurality of inwardly extending slots such as slots 166 and 168. Slots 166 and 168 terminate in enlarged undercut portions 171 and 173 respectively. In the preferred fabrication of connecting body 160, half portions 162 and 163 are fabricated of a resilient material such as molded plastic or the like.

FIG. 26 sets forth a perspective view of a still further alternate connecting body constructed in accordance with the present invention and generally referenced by numeral 190. Connecting body 190 includes a generally cylindrical body 191 defining a passage 192 extending downwardly through the entirety of body 191. In addition, cylindrical body 191 defines a plurality of inwardly extending slots 193, 194, 195 and 196. Slots 193 through 196 terminate in enlarged undercut portions 197 through 200 respectively. In the preferred fabrication of connecting body 190 cylindrical body 191 is fabricated of a resilient molded plastic material or the like.

FIG. 27 sets forth a top view of connecting body 190. As described above, connecting body 190 includes a generally cylindrical body 191 defining a center passage 192 extending therethrough. Cylindrical body 191 further defines a plurality of inwardly extending slots 193, 194, 195 and 196. Slots 193 through 196 terminate in enlarged undercut portions 197 though 200 respectively. In operation, one or more edge portions of plate members such as plate member 310 shown in FIG. 32 may be inserted into slots 193 through 196. During this insertion, body 191 deforms slightly in cooperation with the enlarged undercut portions 197 through 200 to facilitate secure attachment of connecting body 190 to the plate member.

Figure 28:
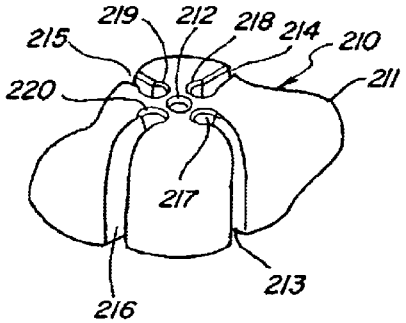
FIG. 28 sets forth a perspective view of a connecting body constructed in accordance with the present invention and having a generally nondescript shape.

FIG. 28 sets forth a perspective view of a still further alternate fabrication of a connecting body constructed in accordance with the present invention and generally referenced by numeral 210. Connecting body 210 includes a body 211 having an illustrative and generally nondescript shape which defines a passage 212 extending downwardly therethrough. Body 211 further defines a plurality of inwardly extending slots 213, 214, 215 and 216 each defining respective enlarged undercut portions 217, 218, 219 and 220. Connecting body 210 functions in substantially the same manner as the above described connecting bodies and is provided to illustrate the present invention ability to accommodate virtually any shape of connecting body.

FIG. 29 sets forth a top view of still further alternate connecting body fabrication constructed in accordance with the present invention and generally referenced by numeral 230. Connecting body 230 defines a cylindrical body 231 having a passage 232 extending downwardly therethrough. Connecting body 230 is similar to connecting body 190 (seen in FIG. 26) with the primary difference being found in the use of flexible rib slot structures for accommodating the edge portions of plate members or the like. More specifically, connecting body 230 includes a plurality of inwardly extending slots 233, 234, 235 and 236 each of which terminates in a respective enlarged undercut portion 237, 238, 239 and 240. A pair of relief slots 241 and 242 are formed on each side of slot 233 to form flexible ribs 265 and 266. Similarly, connecting body 230 defines relief slots 243 and 244 on either side of slot 234 to form flexible ribs 267 and 268. Similarly, a pair of relief slots 245 and 246 are formed on each side of slot 235 to form flexible ribs 306 and 307 while a pair of relief slots 247 and 248 are formed on each side of slot 236 to form flexible ribs 308 and 309. Slots 233 through 236 together with their corresponding flexible ribs and relief slots function in the manner set forth below in FIGS. 54 and 55 to receive and secure the edge portion of one or more plate members. As described above, the importance of the flexible rib and relief slot structures in connecting block 230 is the provision of slot expansion during insertion of the edge portion of a plate member without deforming the remainder of connecting block 230.

FIG. 30 sets forth a top view of a still further alternate connecting block fabrication constructed in accordance with the present invention and generally referenced by numeral 250. Connecting block 250 includes a body 251 defining a triangular prism shape and having a passage 252 extending downwardly therethrough. Connecting block 250 includes inwardly extending slots 253, 254 and 255 each terminating in an enlarged undercut portion 256, 257 and 258 respectively. A pair of relief slots 259 and 260 are formed on each side of slot 253 to form a pair of flexible ribs. Correspondingly, a pair of relief slots 261 and 262 are formed on each side of each slot 254 to provide a pair of flexible ribs. Finally, a pair of relief slots 263 and 264 are formed on each side of slot 255 to provide a pair of flexible ribs. The operation of slots 253 through 255 is substantially identical to the operation of slot 168 shown in FIGS. 54 and 55.

FIG. 31 sets forth a top view of a still further alternate connecting body fabrication constructed in accordance with the present invention and generally referenced by numeral 270. Connecting body 270 includes an octagonal body 271 having a center passage 272 extending therethrough. Each of the eight facets of octagonal body 271 supports a flexible rib slot structure substantially identical to the structures set forth above such as those shown in FIGS. 29 and 30. Thus, connecting body 270 includes a plurality of inwardly extending slots 273, 274, 275, 276, 277, 278, 279 and 280 each terminating in respective enlarged undercut portions 281 through 288. A pair of relief slots 290 and 291 are formed on each side of slot 273 to form flexible ribs 335 and 336 while a pair of relief slots 292 and 293 are formed on each side of slot 274 to form flexible ribs 337 and 338. Similarly, a pair of relief slots 294 and 295 are formed on each side of slot 275 to form a pair of flexible ribs 339 and 349 while a pair of relief slots 296 and 297 are formed on each side of slot 276 to form a pair of flexible ribs 353 and 354. A pair of relief slots 298 and 299 are formed on each side of slot 277 to form flexible ribs 363 and 364 while a pair of relief slots 300 and 301 are formed on each side of slot 278 to form flexible ribs 379 and 380. A pair of relief slots 302 and 303 are formed on each side of slot 279 to form a pair of flexible ribs 381 and 382 while a pair of relief slots 304 and 305 are formed on each side of slot 280 to form a pair of flexible ribs 383 and 384.

Figure 32:
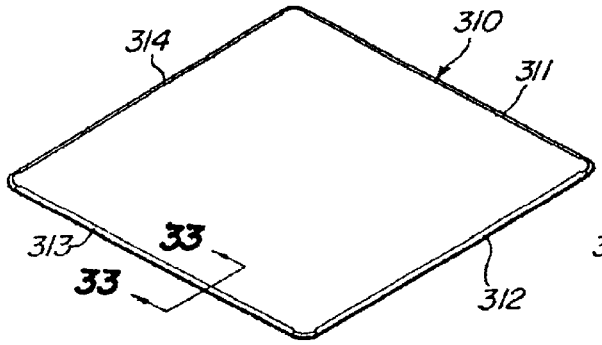
FIG. 32 sets forth a perspective view of a generally rectangular planar plate constructed in accordance with the present invention.
Figure 34:
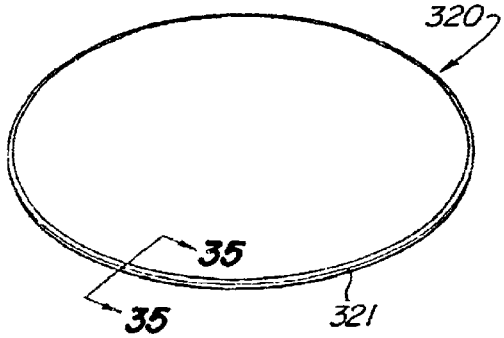
FIG. 34 sets forth a generally circular planar plate constructed in accordance with the present invention.
Figure 36:
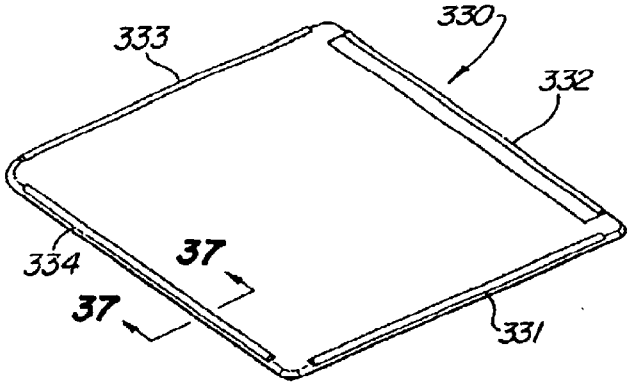
FIG. 36 sets forth a perspective view of an alternate generally rectangular plate constructed in accordance with the present invention.

FIGS. 32, 34 and 36 set forth perspective views of illustrative plate members 310, 320 and 330. Plate members 310 and 330 define generally square shapes while plate member 320 defines a substantially circular shape. In addition, plate members 310, 320 and 330 provide examples of alternative edge structures each illustrative of edge structures which may readily be used in the present invention construction toy set in combination with the above described connecting bodies. It will be apparent to those skilled in the art, that each of the edge structures shown may be utilized in combination with plate members of differing shapes such as the variously shaped plate members shown in FIGS. 38 through 46 as well as those shown in FIGS. 48 and 49 without departing from the spirit and scope of the present invention. Thus, the variously shaped plate member shown in FIGS. 32, 34 and 36 as well as FIGS. 38 through 46 and FIGS. 48 and 49 should be understood to be in no manner limiting as to the possible shapes of plate members which may be utilized within the present invention construction toy set.

More specifically, FIG. 32 sets forth a perspective view of a plate member constructed in accordance with the present invention and generally referenced by numeral 310. Plate member 310 is generally square in shape and planar in character and defines a plurality of edges 311, 312, 313 and 314.

Figure 33:
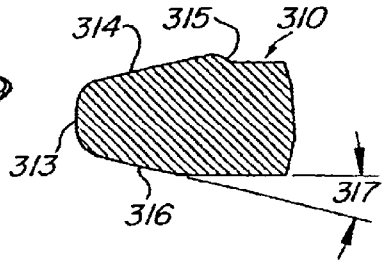
FIG. 33 sets forth a partial section view of the plate shown in FIG. 32 taken along section lines 33—33 therein.
Figure 52:
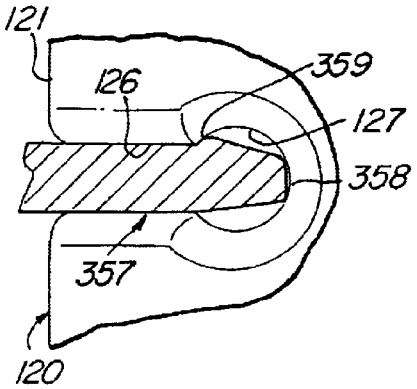
FIG. 52 sets forth a partial section view of an alternate plate member inserted into a connected body constructed in accordance with the present invention.

FIG. 33 sets forth a partial section view of plate member 310 taken along section lines 33—33 in FIG. 32. Plate member 310 includes an edge portion 313 having angled facets 314 and 316 on either side thereof. In addition, a bead portion 315 is formed at the intersection of angled facet 314 and the remainder of plate member 310. Facet 316 defines an angle 317 with the planar portion plate member 310. Angled facets 314 and 316 facilitate insertion of edge 313 into a connecting body slot in the manner set forth below in FIGS. 50 through 55. Particularly FIG. 52 illustrates the particular characteristics of a plate member fabricated in the manner shown for plate member 310.

FIG. 34 sets forth a generally circular plate member generally referenced by numeral 320. Plate member 320 is generally planar in character and defines an outer edge 321.

Figure 35:
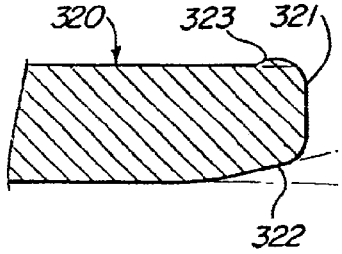
FIG. 35 sets forth a partial section view of the circular plate of FIG. 34 taken along section lines 35—35 therein.
Figure 53:
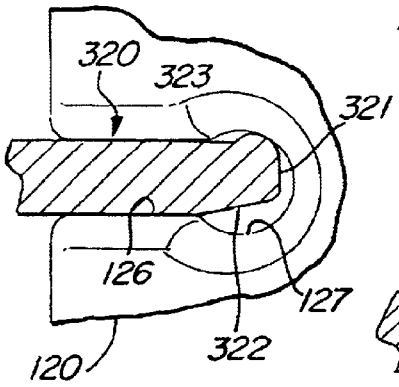
FIG. 53 sets forth a partial section view of a still further alternate embodiment plate member inserted into a connecting body constructed in accordance with the present invention.

FIG. 35 sets forth a partial section view of plate member 320 taken along section lines 35—35 in FIG. 34. Plate member 320 defines an edge portion 321 supporting an upwardly extending bead portion 323 and an angled facet 322. Angled facet 322 facilitates insertion of edge 321 into a connecting body slot while bead 323 aides in securing edge 321 within such as connecting body slot. FIG. 53 below sets forth an illustration of the insertion of a plate member such as plate member 320 into a connecting body slot.

FIG. 36 sets forth a perspective view of a plate member constructed in accordance with the present invention and generally referenced by numeral 330. Plate member 330 is generally square in shape and defines a plurality of edges 331, 332, 333 and 334.

Figure 37:
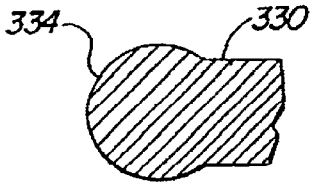
FIG. 37 sets forth a partial section view of the plate shown in FIG. 36 taken along section lines 37—37 therein.
Figure 50:
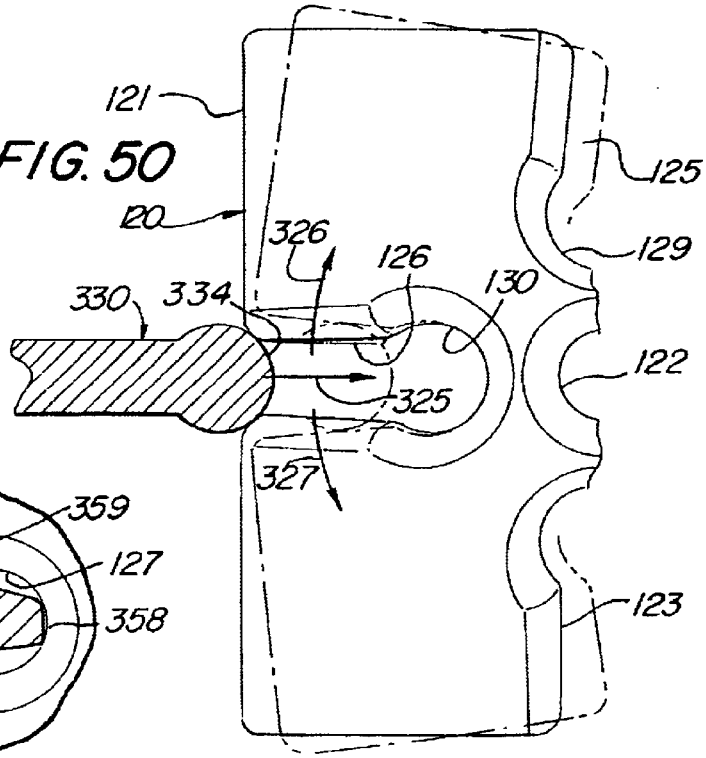
FIG. 50 sets forth a partial section view of a connecting body and plate member constructed in accordance with the present invention.
Figure 51:
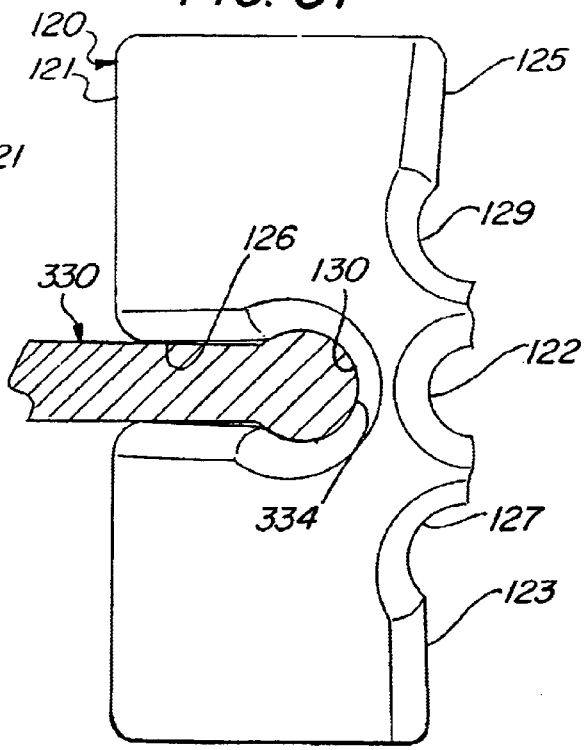
FIG. 51 sets forth the partial section view of the connecting body and plate member shown in FIG. 50 following a typical insertion of the plate member into the connecting body.

FIG. 37 sets forth a partial section view of plate member 330 taken along section lines 37—37 in FIG. 36. Plate member 330 defines a generally cylindrical edge 334 which provides ease of insertion and positive retention into and within a connecting body slot. FIGS. 50 and 51 set forth below illustrate the insertion of a plate member such as plate member 330 into a connecting body slot.

Figure 38:
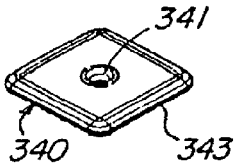
FIG. 38 sets forth a perspective view of a generally square structural element constructed in accordance with the present invention.
Figure 39:
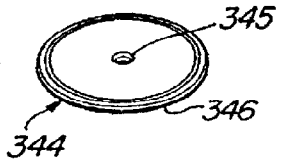
FIG. 39 sets forth a perspective view of a generally circular structural element constructed in accordance with the present invention.
Figure 40:
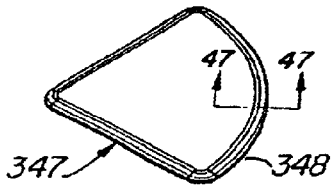
FIG. 40 sets forth a perspective view of a circular segment element constructed in accordance with the present invention.

FIGS. 38, 39 and 40 set forth further examples of variously shaped and configured plate members for use in the present invention construction toy set. FIG. 38 shows a generally square plate member generally referenced by numeral 340 which defines an outer edge 343 and an aperture 341. FIG. 39 shows a generally circular plate member generally referenced by numeral 344 having a center aperture 345 and an outer edge 346. FIG. 40 shows a circular segment plate member generally referenced by numeral 347 defining an outer edge 348. While edges 343, 346 and 348 of plate members 340, 344 and 347 respectively may be shaped in accordance with any of the above described shapes shown for plate members, it has been found convenient to shape edges 343, 346 and 348 in the manner shown in FIG. 47. In the anticipated use of plate members 340, 344 and 347, the overall size thereof is generally selected to be substantially smaller than the plate members set forth and described above within a given construction toy set to provide variety of structure.

Figure 41:
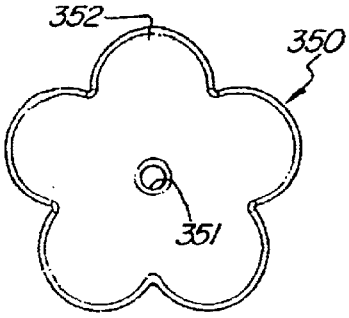
FIG. 41 sets forth a top view of a flower-petal shaped element constructed in accordance with the present invention.
Figure 42:
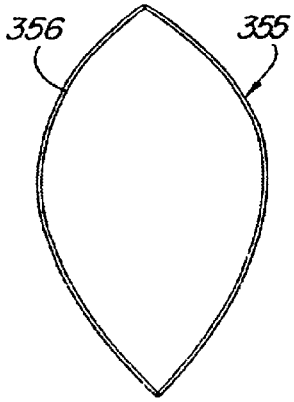
FIG. 42 sets forth a top view of a somewhat elliptical element constructed in accordance with the present invention.
Figure 43:
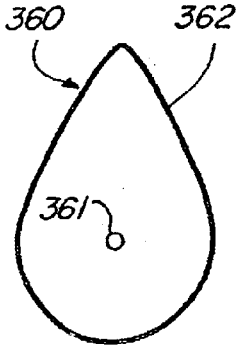
FIG. 43 sets forth a top view of a tear-dropped shaped element constructed in accordance with the present invention.

FIGS. 41, 42 and 43 set forth further alternate shapes for plate members constructed in accordance with the present invention and generally referenced by numerals 350, 355 and 360 respectively. Plate members 350, 355 and 360 are generally shaped to provide a floral shape, a leaf-like shape and a tear-drop shape for use in various aesthetic themes within a construction toy set of the type utilizing the present invention. However, it will be apparent to those skilled in the art that differently shaped plate members may be utilized to obtain differently theme play sets without departing from the spirit and scope of the present invention. More specifically, plate member 350 defines a floral shaped outer edge 352 and an aperture 351. Plate member 355 defines a leaf-like outer edge 356 while plate member 360 defines an aperture 361 and an outer edge 362 generally resembling a tear-drop shape.

Figure 44:
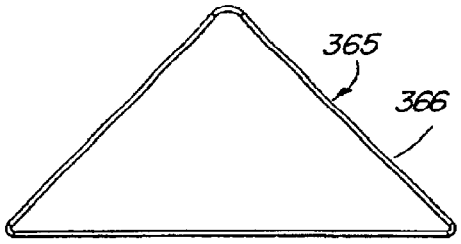
FIG. 44 sets forth a top view of a triangular element constructed in accordance with the present invention.
Figure 45:
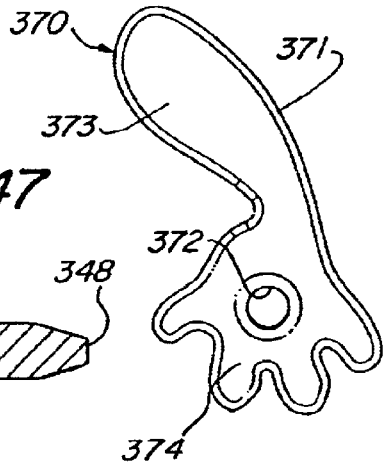
FIG. 45 sets forth a top view of an arm-shaped element constructed in accordance with the present invention.
Figure 46:
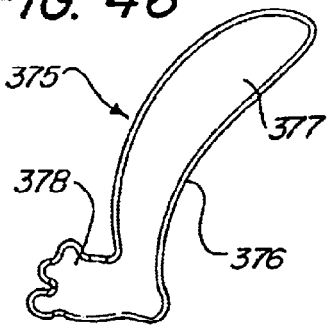
FIG. 46 sets forth a top view of a leg-shaped element constructed in accordance with the present invention.

FIG. 44 sets forth a triangular shaped plate member generally referenced by numeral 365 having an outer edge 366. Outer edge 366 may be fabricated using any of the edge structures set forth herein.

To add further flexibility to the present invention construction toy set, additionally shaped members are utilized to facilitate forming toy figures such as the illustrative toy figure set forth in FIG. 57. Thus, FIG. 45 sets forth a plate member generally referenced by numeral 370 having an outer edge 371 which is multiply curved to form an arm portion 373 and a hand portion 374. An aperture 372 is formed in hand portion 374. Similarly, FIG. 46 sets forth a plate member 375 having an outer edge 376 which is multiply curved to form a leg portion 377 and a foot portion 378.

Figure 47:
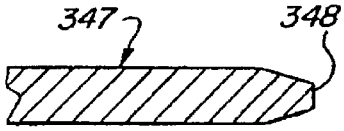
FIG. 47 sets forth a partial section view of the element shown in FIG. 40 taken along section lines 47—47 therein.

FIG. 47 sets forth a partial section view of plate member 347 taken along section lines 47—47 in FIG. 40. Plate member 347 defines a tapered edge portion 348. The tapered character of edge portion 348 facilitates the insertion of edge 348 into a connecting slot. This insertion is illustrated in FIGS. 54 and 55.

FIG. 48 sets forth a perspective view of a curved plate member constructed in accordance with the present invention and generally referenced by numeral 480. Plate 480 is generally cylindrical and defines a pair of parallel straight edges 481 and 483. Plate 480 further defines a pair of generally curved circular edges 482 and 484. In accordance with the present invention, edges 481 through 484 of curved plate 480 remain capable of insertion into the slots of a connecting body in the manner described above. In such case, the curvature of plate member 480 is sufficiently large in radius of curvature to maintain attachment within a connecting body slot.

FIG. 49 sets forth a perspective view of a curved plate member generally referenced by numeral 490 and constructed in accordance with the present invention. Plate member 490 is generally cylindrical in shape and corresponds generally to a quarter cylinder. Thus, curved plate member 490 defines a pair of parallel straight edges 491 and 493 together with a pair of cylindrically curved edges 492 and 494. As mentioned above, in the description of plate member 480, plate member 490 defines a radius of curvature which is sufficiently large to facilitate the insertion of its edge portions into the connecting slots of a connecting body in much the same manner as described above for generally planar members.

FIG. 50 sets forth a partial section view showing a typical insertion of a plate member into a typical slot in a connecting body. In the position shown in FIG. 50, the plate member is positioned such that its edge is aligned with the entrance to the slot formed in the connecting body.

More specifically, a connecting body 120 having a generally cubic body 121 defines a slot 126 terminating in an enlarged undercut 130. Connecting body 120 further defines slots 123 and 125 having enlarged undercut portions 127 and 129. A passage 122 is formed at the approximate center of connecting body 120. A plate member 330 defines a generally cylindrical edge portion 334.

With edge 334 positioned as shown at the entrance to slot 126, the user then forces plate 330 and edge 334 into slot 126 in the direction indicated by arrow 325. The resilient character of the material from which body 121 is formed, allows body 121 to flex outwardly as indicated by arrows 326 and 327 to the expanded position shown in phantom line drawing in FIG. 50.

Thereafter, the user continues to force edge 34 into slot 126 until it is received within enlarged undercut 130. It will be noted that the outward flexing of slot 126 to receive the enlarged size of edge 334 of plate member 330 is facilitated by undercut 130. The user continues to drive edge 334 of plate member 330 into slot 126 until cylindrical edge 334 is received within undercut 130.

FIG. 51 sets forth the partial section view shown in FIG. 50 of connecting body 120 and plate member 330 following the completion of the edge insertion described above. At the point shown in FIG. 51, edge 334 of plate member 330 is seated within the connecting body slot and is maintained securely.

More specifically, a connecting body 120 having a generally cubic body 121 defines a slot 126 terminating in an enlarged undercut 130. Connecting body 120 further defines slots 123 and 125 having enlarged undercut portions 127 and 129. A passage 122 is formed at the approximate center of connecting body 120. A plate member 330 defines a generally cylindrical edge portion 334.

It will be apparent to those skilled in the art that the resilient character of the material from which connecting body is fabricated, causes the side portions of slot 126 to provide positive pressure against the surfaces of plate member 330. It will be further apparent to those skilled in the art that the enlarged size of cylindrical edge 334 cooperates with the enlarged size of undercut 130 to further secure plate member 330 within connecting body 120.

The removal process for plate member 330 is substantially the reverse as the above described insertion process in that the user simply applies a drawing force upon plate member 330 with respect to connecting body 120 to overcome the resilient retaining force thereof and withdraw plate member 330.

FIG. 52 sets forth a partial section view of an alternative combination of connecting block slot and plate member edge attachment. Connecting body 120 includes a cubic body 121 defining a slot 126 therein. Slot 126 terminates in an enlarged undercut portion 127. A plate member 357 defines an edge portion 358 having tapered facets and a bead portion 359. In the inserted position shown in FIG. 52, edge 358 has been forced through 126 causing cubic body 121 to flex outwardly in a similar manner to that set forth above in FIG. 50 to facilitate the passage of bead 359 into undercut portion 127. Once bead 359 enters enlarged undercut portion 127, the resilience of the material forming cubic body 121 forces slot 126 against plate member 357 securing edge 358. It will be understood that a reverse action of withdrawing plate member 357 causes a corresponding outward flex of cubic body 121 as bead 359 passes through slot 126.

FIG. 53 sets forth a partial section view similar to the section view shown in FIG. 52 which illustrates a still further alternative combination of connecting body fabrication and plate member. More specifically, connecting body 120 includes a cubic body 121 defining a slot 126 terminating in an enlarged undercut portion 127. A plate member 320 includes an edge 321 having an angled facet 322 and an upwardly extending bead 323. In a similar process to the above described operation shown in FIG. 50, plate member 320 is forced into slot 126 causing slot 126 to flex outwardly as bead 323 passes through slot 126 into undercut 127. Thereafter, the resilient character of connecting body 120 causes the closure of slot 126 against plate member 320. As a result, the frictional force upon plate member 320 by the surfaces of slot 126 together with the extension of bead 323 into undercut 127 maintains the secure attachment of plate member 320 to connecting body 120.

Figure 54:
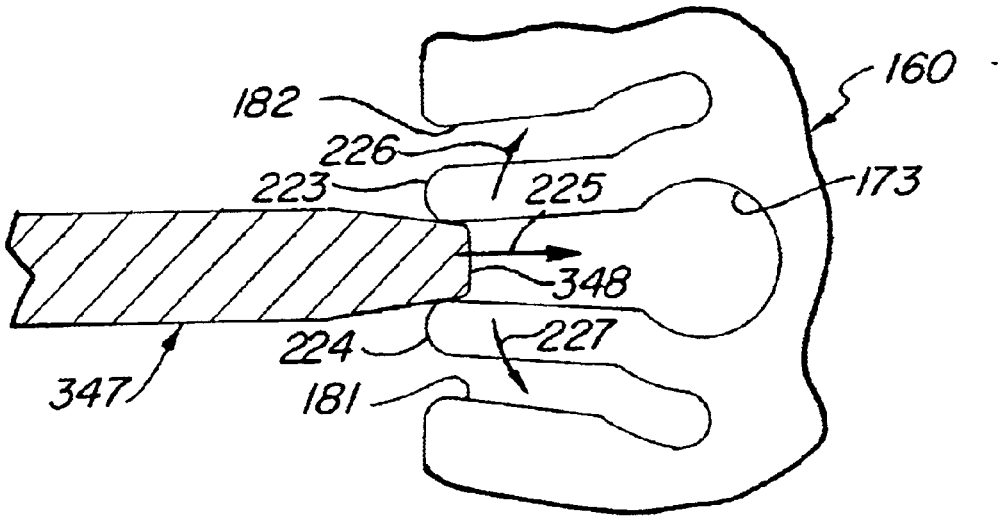
FIG. 54 sets forth a partial section view of a plate member and alternate embodiment connecting body of the present invention prior to insertion.
Figure 55:
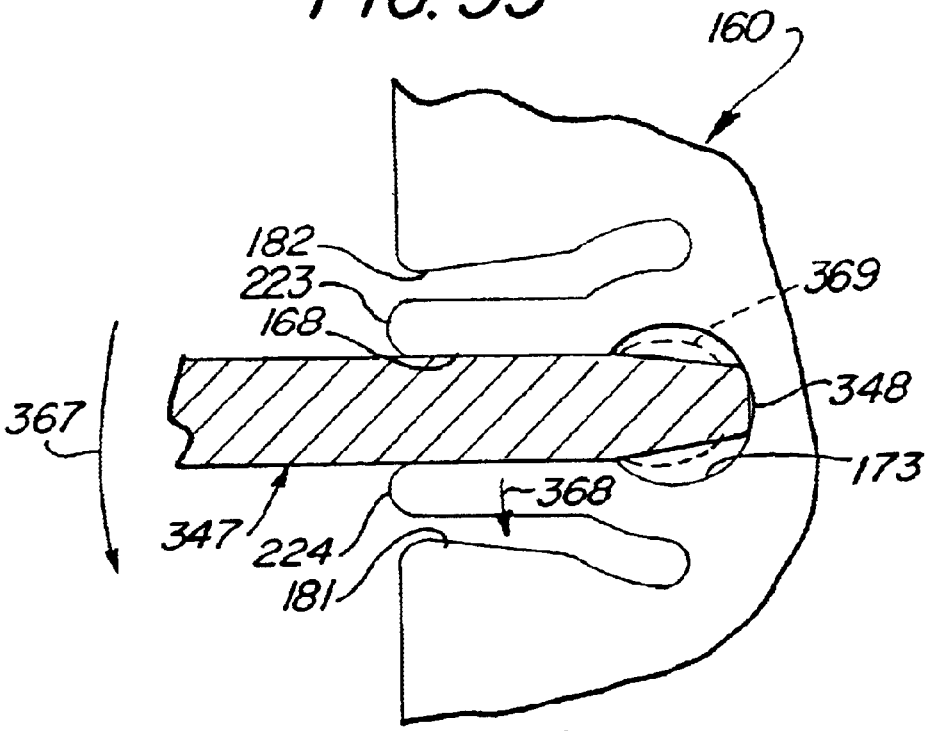
FIG. 55 sets forth the partial section view of FIG. 54 following insertion of the plate member into the connecting body.

FIGS. 54 and 55 set forth partial section views of an illustrative attachment between a plate member and a connecting body having the improved slot structure utilizing relief slots and flexible ribs such as that shown in FIGS. 11 through 13, 23 and 24, and 29 through 31. FIG. 54 a shows a plate member positioned for insertion into the slot of a connecting body while FIG. 55 shows the plate member inserted into and secured to a connecting body.

More specifically, a connecting body 160 defines a slot 168 having an enlarged undercut portion 173. Connecting body further includes a pair of relief slots 181 and 182 on each side of slot 168. The presence of relief slots 182 and 183 on each side of slot 168 forms a pair of flexible ribs 223 and 224. A plate member 347 defines a tapered edge 348.

In the position shown, edge 348 of plate member 347 is positioned at the entrance of slot 168. Thereafter, the user forces plate member 347 into slot 168 in the direction indicated by arrow 225. The insertion of edge 248 into slot 168 forces flexible ribs 223 and 224 outwardly in the directions indicated by arrows 226 and 227. It will be noted that the outward flexing of flexible ribs 223 and 224 is accommodated by relief slots 182 and 181 respectively. As a result, the remainder of connecting body 160 is not deformed by the insertion of plate member 347. Thereafter, as the user continues to force plate member 347 into slot 168 and as flexible ribs 223 and 224 flex outwardly to accommodate the insertion of edge 348, edge 348 eventually bottoms out against enlarged undercut portion 173. At this point (shown in FIG. 55) plate member 347 is fully inserted into connecting body 160.

FIG. 55 sets forth the partial section view of FIG. 54 in which edge 348 of plate member 347 is fully inserted into connecting body 160.

More specifically, a connecting body 160 defines a slot 168 having an enlarged undercut portion 173. Connecting body further includes a pair of relief slots 181 and 182 on each side of slot 168. The presence of relief slots 182 and 183 on each side of slot 168 forms a pair of flexible ribs 223 and 224. A plate member 347 defines a tapered edge 348.

In the fully inserted position shown in FIG. 55, flexible ribs 223 and 224 provide a grasping force against plate member 347 which aides in retaining plate member 347 in a secure attachment. For purposes of illustration, an alternative edge structure for edge 348 is shown in dash-line representation 369 to demonstrate the use of an enlarged bead within the structure of edge 348. In such case, enlarged bead 369 cooperates with undercut portion 173 to further secure plate member 347 within slot 168.

FIG. 55 also provides illustration of the present invention construction toy set fabrication which allows the residence of substantial loads upon the various structures fabricated utilizing the present invention connecting bodies and plate members. For example, in the event plate member 347 is subjected to a significant load in the direction indicated by arrow 367, a torch or rotational force is imparted to plate member 347 which is also directed as indicated by arrow 367. In such case, the flexible character of flexible ribs 223 and 224 cause rib 224 to flex downwardly in the direction indicated by arrow 368. As flexible rib 224 flexes downwardly in the direction indicated by arrow 368, relief slot 181 narrows until, under significant load, the outer end of flexible rib 224 touches the lower surface of relief slot 181. At this point, further flexing of rib 224 is resisted by the underlying portion of connecting body 160 providing a substantially greater resistance to the load force. In this manner, the structural attachment between plate member and connecting body facilitates relative small adjustments under load while resisting the tendency to yield substantially under significant loads. This provides substantial advantage when the present invention construction toy set is utilized in fabricating various complex and load-bearing structures.

FIG. 56 sets forth a perspective view of an illustrative complex structure produced utilizing the present invention construction toy set. It will be understood that the structure shown in FIG. 56 is utilized for illustration and that various other structures of differing shapes and configurations may be fabricated utilizing the present invention construction toy set without departing from the spirit and scope of the present invention. Thus, the combined structure generally referenced by numeral 390 shown in FIG. 56, may be seen to be fabricated of a plurality of generally planar plate members mutually secured by interlocking connecting bodies of the type set forth and described above. Structure 390 includes a pair of plate members 391 and 393 secured at right angles by a connecting body for ten. The attachment between plate members 391 and 393 is facilitated by inserting the edge portions thereof into the appropriate slots of connecting body 410. In addition, a plate member 392 is secured to the upper edges of plate members 391 and 393 by a plurality of generally spherical connecting bodies for 413, 414 and 422. Once again, the attachment between connecting bodies and plate members is accomplished utilizing the above described edge insertion into slot portions of the connecting bodies. In addition, structure 390 includes a plate member 310 having edges 311, 312, 313 and 314 which is further secured to the combination of plate members 391 and 392 by connecting bodies 413 and 414. A triangular shape plate member 365 having an outer edge 366 is secured to edge 314 of plate member 310 by connecting bodies 415 and 416.

Structure 390 further includes a pair of plate members 396 and 397 secured at right angles by a connecting body 412. In addition, plate member 397 is stabilized in its vertical position by attachment of a connecting body 411. While not seen in FIG. 56 due to the perspective view thereof, it will be understood that plate member 396 is also secured to connecting body 410 to further stabilize structure 390. A plate member 417 is mutually secure to the upper edges of plate members 396 and 397 by connecting bodies 423 and 424 and connecting bodies 427 and 428 respectively. In addition, a triangular plate member 398 is further secured to plate members 417 and 397 by connecting bodies 427 and 428.

A plate member 394 is secured to plate members 396 and 417 by connecting bodies 423 and 424. Plate member 394 further supports a triangular plate member 395 utilizing connecting bodies 425 and 426.

A fancifully curved plate member 399 is secured to plate members 392 and 393 by connecting body 422. In addition, a pair of smaller plate members 400 and 401 are secured to plate member 399 by connecting bodies 420 and 421 respectively.

The various connecting bodies shown in FIG. 56 are illustrative of the various connecting bodies set forth above and may be interchangeable utilized within a structure such as structure 390 in accordance with the present invention. The entire structure may be further modified and revised by the child user either by adding additional connecting bodies and plate members or by removing and repositioning selected ones of the connecting bodies and plate members. The important aspect with respect to the present invention to be realized in FIG. 56, is that the variously shaped connecting bodies set forth above may be interchangeable utilized in forming a more complex structure of plate members in which assembly is a simple plate insertion operation.

FIG. 57 sets forth a perspective assembly view of a toy figure constructed in accordance with the present invention and generally referenced by numeral 430. Toy FIG. 430 will be understood to be illustrative of the various toy figures which may be fabricated using different combinations of connecting bodies and plate members. It will be understood that the plate members and connecting bodies of the present invention are capable of fabricating a virtually endless variety of toy figures all of which fall within the spirit and scope of present invention.

More specifically, toy FIG. 430 includes a connecting body 140 having a plurality of inwardly extending slots 143, 144, 145 and 146. Each connecting slot terminates in an enlarged undercut 147, 148, 149 and 150 respectively. Connecting body 140 further defines a passage 142 extending therethrough. In further accordance with the present invention, an elongated rod 30 having a lower end 31 is inserted into passage 142 to provide a vertical support. In addition, a pair of plate members 460 and 462 are inserted into slots 144 and 146 respectively to provide further support for toy FIG. 430. A generally cylindrical member 446 defining a passage 447 therethrough is received upon rod 30 and rests upon the upper surface of connecting body 140. Thereafter, a connecting body 440 having a generally spherical shape and defining a passage 441 therethrough is further received upon rod 430 and rests upon member 446. Connecting body 440 defines a pair of inwardly extending slots 442 and 443. Toy FIG. 430 further includes a pair of arm members 450 and 453. Arm member 450 includes an arm portion 451 and a hand portion 452. Arm portion 451 is inserted into slot 442 of connecting body 440. Similarly, arm member 453 includes an arm portion 454 and a hand portion 456. Arm portion 454 is inserted into slot 443.

A cylindrical member 444 defines an aperture 445 and is assembled upon rod 30 and rests upon the upper portion of connecting body 440. A connecting body 431 defines a center passage 434 and a pair of inwardly extending slots 432 and 433. Connecting body 431 is assembled to end portion 32 of rod 30. End 32 extends into but not entirely through connecting body 431.

Figure 58:
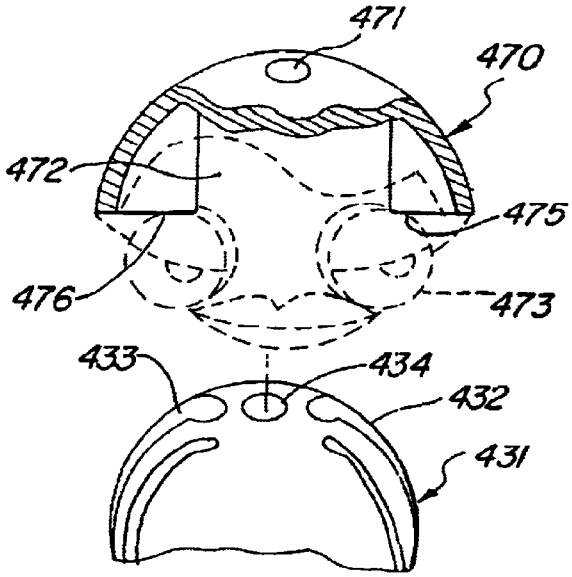
FIG. 58 sets forth a partial section view of the head and connecting spherical body portion of the Figure formed in FIG. 57.

A head unit 470 defines a generally semi-spherical member defining an interior cavity 472 (better seen in FIG. 58). Head member 470 further defines a fanciful face indicia 473. Head member 470 further defines an aperture 471 in the upper portion thereof. The internal structure of head member 470 is set forth below in FIG. 58 in greater detail. However, suffice it to note here that interior cavity 472 of head member 470 is sized and configured to allow head member 470 to rest upon and partially cover the upper surface of a spherical member such as connecting body 431. The combination of head member 470 and spherical connecting body 431 provides a fanciful simulation of a figures head and face. Toy FIG. 430 is completed by a crown member 496 having a downwardly extending post 497. With head member positioned upon connecting body 431 such that aperture 471 is aligned with passage 434 thereof, post 497 may be passed through aperture 471 into the upper portion of passage 434 to secure crown member 496 in place. The resulting toy figure is thereafter useable in virtually any play pattern designed by the child user. However, in the preferred fabrication of the present invention, a plurality of toy figures assembled in a similar manner to toy FIG. 430 may be utilized in combination with a structure such as structure 390 shown in FIG. 56.

In accordance with an important aspect of the present invention, a plurality and virtually endless variety of toy figures may be fabricated utilizing the various connecting bodies and plate members provided in the present invention construction toy set. For example, an alternative crown member 498 having a downwardly extending post 499 may be utilized in place of crown member 496 in the above described assembly. Further, an alternative head member 500 having an aperture 501 and an interior cavity 505 may be substituted in place of head member 470 and assembled to connecting body 431 to further vary toy FIG. 430. By way of further example, fanciful plate members 460 and 462 may be replaced by a pair of leg members 502 and 503 which are similarly inserted into slots 144 and 146 of connecting body 140. The foregoing variations of FIG. 430 are provided for purposes of illustration. However, it will be apparent to those skilled in the art that a plurality of substantially different and varied toy figures may be fabricated utilizing the interchangeable members and connecting bodies of the present invention construction toy set without departing from the spirit and scope of the present invention.

FIG. 58 sets forth a partial section perspective view of the interior structure of head member 470. It will be apparent to those skilled in the art that the structure of head member 470 is illustrative of the corresponding structures found in alternative head members such as head member 500 shown in FIG. 57. Head member 470 is generally semi-spherical in structure and defines a spherical internal cavity 472. Head member 470 further defines an aperture 471 and a face portion 473. The frontal portion including face portion 473 of head member 470 is shown in dash-line depiction to facilitate illustration of the interior structure of head member 470. In its preferred fabrication, head member 470 further includes a pair of inwardly extending flange portions 475 and 476. The size and configuration of flanges 475 and 476 is selected to correspond with and properly fit within slots 432 and 433 of connecting body 431. Thus, as head member 470 is assembled upon the upper portion of connecting body 431 such that aperture 471 is aligned with passage 434 of connecting body 431, flanges 475 and 476 are received within slots 432 and 433 of the connecting body. This cooperation of flanges 475 and 476 with slots 432 and 433 facilitates the proper alignment of head member 470 with respect to the remainder of the toy figure and provides a secure attachment between head member 470 and connecting body 431.

Figure 59:
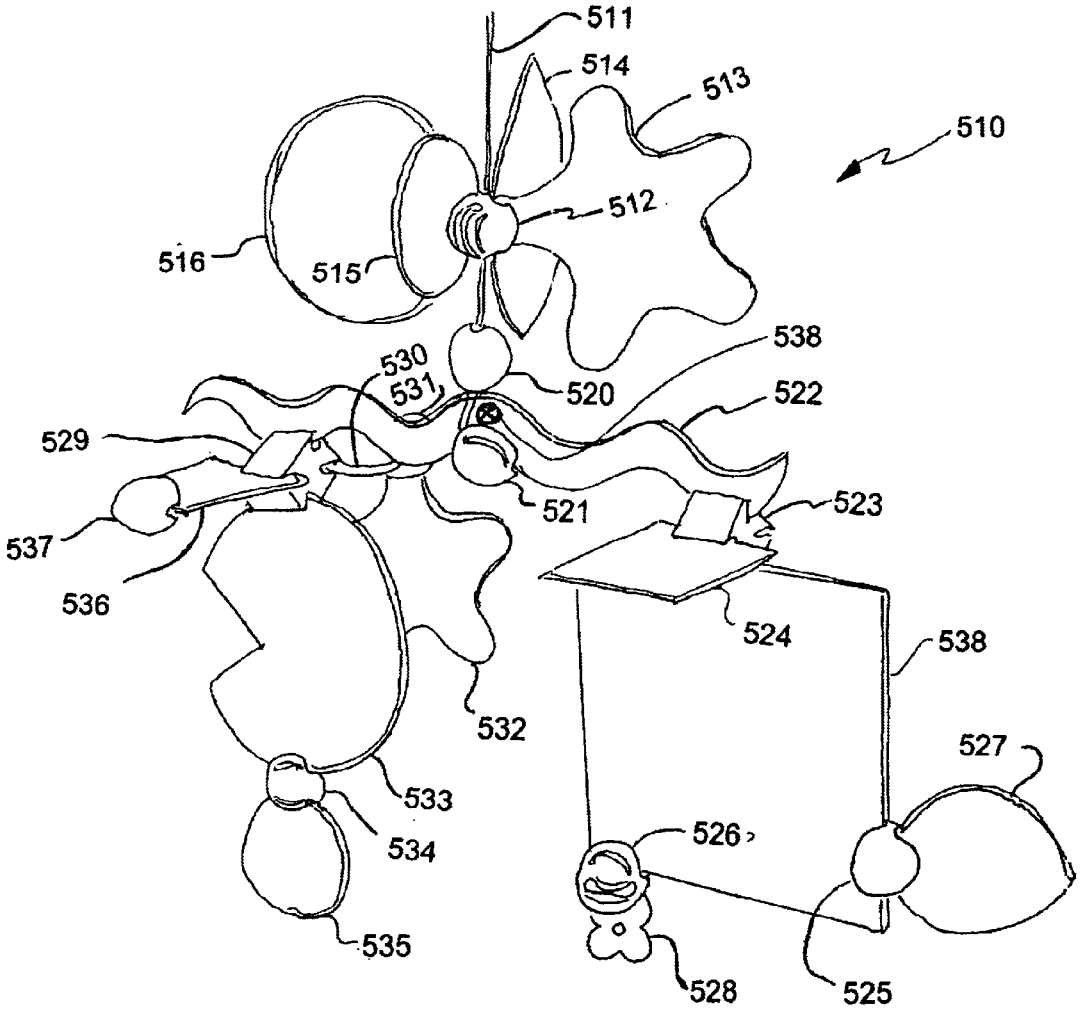
FIG. 59 sets forth a perspective view of an assembly constructed in accordance with the present invention to form a mobile.

FIG. 59 sets forth a perspective view of a mobile constructed in accordance with the present invention construction toy set and generally referenced by numeral 510. Mobile 510 is fabricated utilizing a plurality of connecting bodies and plate members of different sizes, shapes and structures such as those set forth above together with an elongated flexible element 511. In its preferred form, flexible element 511 comprises a string or relatively thin cord. However, element 511 may also be provided by a monofilament type material such as fishing line or the like. By way of further alternative, flexible element 511 may comprise a ribbon or other material.

Structure 510 includes a connecting body 512 having a plurality of plate members 513, 514, 515 and 516 joined by inserting portions of each plate member into slots formed in connecting body 512 in the manner described above. In addition, flexible element 511 is passed through one of the slots of connecting body 512. Structure 510 further includes a connecting body 520 secured to flexible element 511 together with a connecting body 521. Connecting bodies 520 and 521 are spherical in shape and fabricated in accordance with any of the various structures set forth above. An elongated curving plate member 522 is secured within a selected slot formed in connecting body 521. The lower end of flexible element 511 is joined to plate member 522 and connecting body 521 using a simple tied knot or alternatively, passing the lower end of element 511 through the slot formed in connecting body 521 which receives plate member 522. Plate member 522 defines a general center of gravity indicated by indicia 538. In accordance with the desire to fabricate a mobile which hangs conveniently, and in a relatively stable horizontal orientation from flexible element 511, the remaining elements of structure 510 secured to plate member 522 are evenly distributed on each side of center of gravity 538. It will be apparent to those skilled in the art that a virtually endless variety of combinations of connecting bodies and plate members may be attached to plate member 522 to provide differing appearances while satisfying this general balancing criteria.

In the structure of 510, a cubic connecting body 523 is secured to one end of plate member 522 by insertion into a slot thereof. A pair of plate member 524 and 538 are received within additional slots formed in connecting body 523 for secure attachment. A pair of spherical connecting bodies 525 and 526 are secured to the lower portion plate member 538. Connecting body 525 further supports a plate member 527 while connecting body 526 further supports a plate member 528.

On the opposite side of plate member 522, a generally cubic connecting body 529 is secured to the lower edge of plate member 522 by insertion into a slot thereof. In addition, a trio of plate members 530, 533 and 536 are secured within additional slots formed in connecting body 529. Plate member 536 further supports a spherical connecting body 537 while plate member 530 further supports a connecting body 531 which in turn supports a downwardly extending plate member 532. Structure 510 is completed by a connecting body 534 secured to plate member 533 which in turn supports a plate member 535.

It will be apparent to those skilled in the art that the convenient edge insertion attachment between the various plate member edges and slots formed in the various connecting bodies facilitates a simple, convenient and interesting method of assembling a complex structure such as structure 510. It will be further apparent to those skilled in the art that this convenient attachment allows further modification on an ongoing basis to provide increased developmental activity for the child user.

Figure 60:
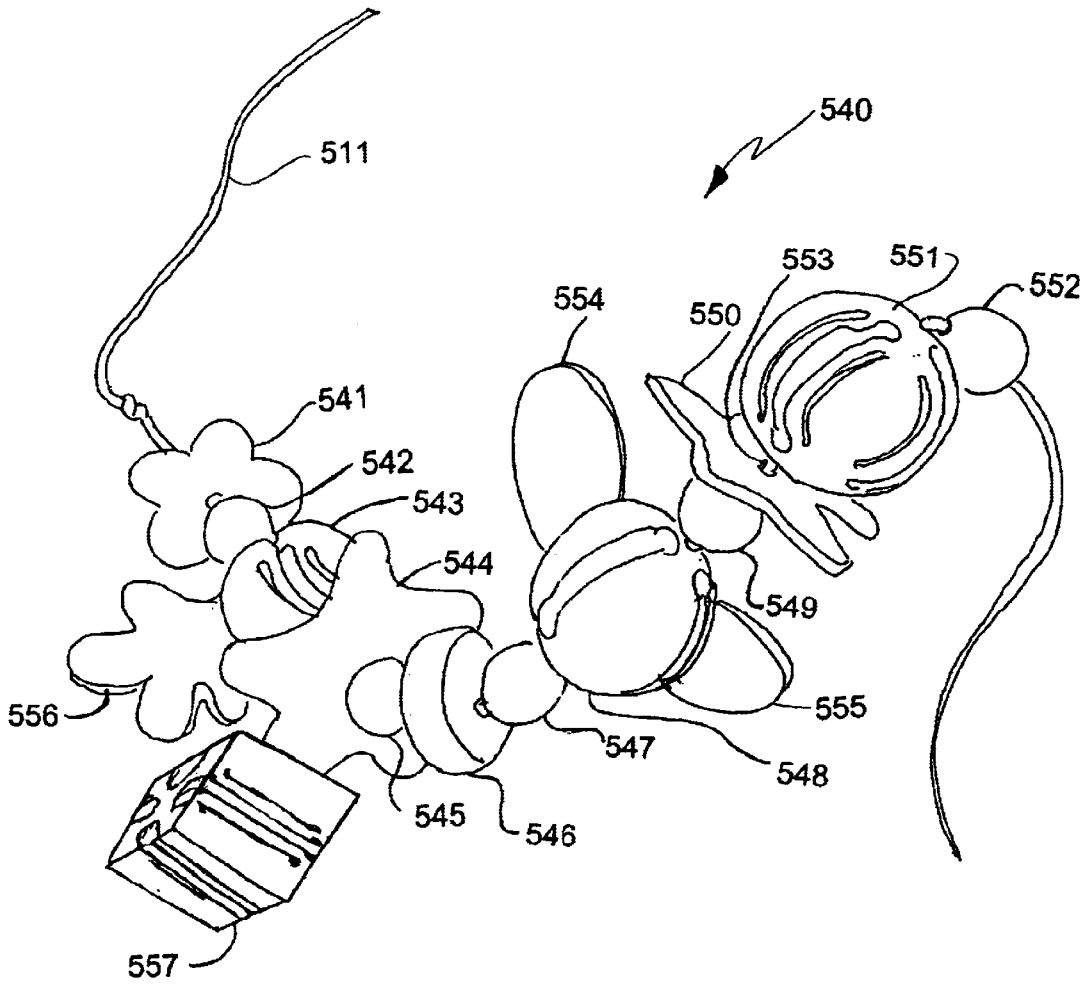
FIG. 60 sets forth a perspective view of an assembly constructed in accordance with the present invention to form a jewelry article.

FIG. 60 sets forth a perspective view of a jewelry article constructed in accordance with the present invention and generally referenced by numeral 540. In the assembly of jewelry article 540 the various plate members and connecting bodies selected for assembly are chosen from the above described connecting bodies and plate members which define apertures therethrough. In addition, an elongated flexible element 511 which, as described above in FIG. 59, preferably comprises a flexible cord or string or alternative flexible elements is used to secure the various plate members and connecting bodies chosen for inclusion of the article 40 by simply stringing the flexible element through the passages and apertures formed therein.

More specifically, jewelry article 540 which may for example, be a necklace or bracelet, includes a plurality of connecting bodies 543, 548 and 551 each having a passage formed therein as described above. Correspondingly, a plurality of plate members 541, 544, 546 and 550 are also chosen from the above described plate members which define an aperture therethrough. For example, plate member 550 defines an aperture 553 therein. In addition, jewelry article 540 includes a plurality of conventional beads 542, 545, 547, 549 and 552 to further enhance the general attractiveness of jewelry article 540. It will be apparent to those skilled in the art that a virtually endless variety of plate members and connecting bodies may be strung upon flexible element 511 as desired to provide the chosen combination for the desired appearance of jewelry article 540. In accordance with an important aspect of the present invention, in fabricating article 540, a plurality of plate members may be secured to one or more of the connecting bodies strung upon flexible element 511. This attachment is carried forward by the insertion of an edge portion of the plate members into a convenient slot within the selected connecting body. This attachment is amply described above, and is shown in FIG. 60 as the attachment between additional plate members 554 and 555 to connecting body 548. Similarly, a plate member 556 is inserted partially into connecting body 543 at a convenient slot (not seen) to secure plate member 556. It will be apparent to those skilled in the art that the utilization of additional connecting bodies may also be secured to the various plate members strung upon flexible element 511 to further enhance the resulting jewelry article structure. By way of example, a connecting body 557 is shown secured to plate member 544 by edge insertion into a connecting body slot.

What has been shown is a construction toy set having a plurality of generally planar plate members which are connectable by a plurality of connecting bodies. The connecting bodies define appropriate slot structures for receiving the edge portions of the plate members in an easily assembled by secure attachment particularly suited for younger children. The construction toy set is flexible in use and facilitates fabrications of relatively complex and varied structures as well as fanciful toy figures. The entire construction toy set may be themed as desired to provide a general appearance or character consistent with the desired use. The entire compliment of elements of the construction toy set may be fabricated of relatively inexpensive molded plastic components and is suitable for mass production and mass marketing.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A construction toy set comprising:

a plurality of connecting bodies each defining a three-dimensional body having an outer surface, a passage through said three-dimensional body and a plurality of slots each extending inwardly from said outer surface and each terminating within said body in an enlarged undercut portion;

a plurality of generally planar plate members each having opposed surfaces and outer edges, said edges including edge portions configured and sized to be inserted into selected ones of said slots;

a head member having a face portion, a passage and an interior cavity for receiving a portion of a selected one of said connecting bodies; and an elongated rod sized to fit within said passages, said bodies being formed of a resilient material such that said slots deform elastically when one of said edge portions is inserted into one of said slots to secure said connecting body to said plate member, combinations of said plate members being joined by said connecting bodies to form portions of toy figures including appendages, said connecting bodies being stacked in a vertical array with said rod passing through said passages and said head member being received upon the uppermost one of said connecting bodies.

2. The construction toy set of claim 1 wherein said uppermost connecting body is generally spherical.

3. The construction toy set of claim 2 wherein said head member includes a pair of flanges supported within said interior cavity received within a pair of said slots formed in said uppermost connecting body.

4. The construction toy set of claim 3 further including a first crown member receivable upon said head member and having a first post extending into said aperture in said head member.

5. The construction toy set of claim 4 further including a second crown member receivable upon said head member and having a second post extending into said aperture in said head member, said first and second crown members being interchangeable to form different toy figure appearances.

* * * * *